US006858812B2

(12) United States Patent
Sasaki et al.

(10) Patent No.: US 6,858,812 B2
(45) Date of Patent: Feb. 22, 2005

(54) PUSH-BUTTON SWITCH

(75) Inventors: Schunkichi Sasaki, Okayama (JP); Yasuhiro Takebayashi, Okayama (JP); Satoru Takahashi, Kyoto (JP); Tatsushi Yonezawa, deceased, late of Nagokakyo (JP); by Yukiko Yonezawa, legal representative, Ashiya (JP); Masaki Sugihara, Hikawa-gun (JP); Yoshikazu Hirai, Ohtsu (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/615,392

(22) Filed: Jul. 9, 2003

(65) Prior Publication Data

US 2005/0006215 A1 Jan. 13, 2005

(51) Int. Cl.[7] ..... H01H 13/70
(52) U.S. Cl. ..... 200/344; 200/341
(58) Field of Search ..... 200/341, 344, 200/345, 315, 5 A, 517; 400/490, 491, 495, 495.1, 491.2, 496

(56) References Cited

U.S. PATENT DOCUMENTS

| | | | | | |
|---|---|---|---|---|---|
| 5,247,143 | A | * | 9/1993 | Suwa | 200/517 |
| 5,268,545 | A | * | 12/1993 | Bruner | 200/345 |
| 5,813,521 | A | * | 9/1998 | Koike et al. | 200/344 |
| 6,060,676 | A | * | 5/2000 | Pan | 200/344 |
| 6,586,695 | B2 | * | 7/2003 | Sato et al. | 200/344 |
| 6,706,985 | B2 | * | 3/2004 | Chun | 200/344 |

* cited by examiner

*Primary Examiner*—Lincoln Donovan
*Assistant Examiner*—M. Fishman
(74) *Attorney, Agent, or Firm*—Foley & Lardner LLP

(57) ABSTRACT

A switch driving portion includes a lever link mechanism which as a pair of lever members respectively rocking about a rocking fulcrum by interlocking with a push button portion when the push button portion is pushed and arranged so as to be faced each other and in which the both lever members are connected each other at their faced ends by joint members so that they can be folded and slid and a switch operating member for opening or closing a built-in switch when the lever link mechanism is rocked by pushing in the push button portion.

6 Claims, 23 Drawing Sheets

1 CASE
1A BOTTOM FACE
2 BUILT-IN SWITCH (SWITCH PORTION)
3 SWITCH DRIVING PORTION
4 ILLUMINATING PORTION
5 PUSH BUTTON PORTION
51 MUFFLING MEMBER
54 SUBSTRATE SETTING PORTION
57 STOPPER MEMBER
60 REFLECTION CASE
60A REFLECTION PLATE
61 LIGHT GUIDING PLATE
62 LED MODULE
64 KEY TOP
65 CHARACTER PLATE
66 DIFFUSION PLATE
67 OPERATING SHAFT
73 SHOCK ABSORBING MEMBER
74 CLAMP

1 CASE
1A BOTTOM FACE
2 BUILT-IN SWITCH (SWITCH PORTION)
3 SWITCH DRIVING PORTION
4 ILLUMINATING PORTION
5 PUSH BUTTON PORTION
51 MUFFLING MEMBER
54 SUBSTRATE SETTING PORTION
57 STOPPER MEMBER
60 REFLECTION CASE
60A REFLECTION PLATE
61 LIGHT GUIDING PLATE
62 LED MODULE
64 KEY TOP
65 CHARACTER PLATE
66 DIFFUSION PLATE
67 OPERATING SHAFT
73 SHOCK ABSORBING MEMBER
74 CLAMP

10F JOINT MEMBER HOUSING
10R JOINT MEMBER HOUSING
6 LEVER-MEMBER SETTING PORTION
6L LEFT LEVER-MEMBER SETTING PORTION (ONE LEVER-MEMBER SETTING PORTION)
6N RIGHT LEVER-MEMBER SETTING PORTION (THE OTHER LEVER-MEMBER SETTING PORTION)
7 SWITCH SETTING PORTION

22 OPERATING-SHAFT SETTING PORTION
27 GUIDE PROTRUSION
75 MUFFLING-MEMBER SETTING PORTION
76 SWITCH-OPERATING-MEMBER SETTING PORTION
77 SHOCK-ABSORBING-MEMBER SETTING PORTION

30 PUSH BUTTON (EXTERNAL OPERATING PORTION)
34L LEFT (ONE) LEVER MEMBER
34N LEFT (THE OTHER) LEVER MEMBER
36 CONNECTING SHAFT
38F ARM (ONE ARM)
38R ARM (THE OTHER ARM)
40F SUPPORT
41F CONNECTING PORTION (ONE LEVER-SIDE FIXING PORTION)
42F PIN PORTION (ONE LEVER-SIDE FIXING PORTION)
42R PIN PORTION (ONE LEVER-SIDE SLIDING PORTION)
F LEVER LINK MECHANISM
P SLIDING FULCRUM
Q LEVER FOLDING POINT

45 PIN INSERTING HOLE (JOINT-SIDE FIXING PORTION)
46 PIN INSERTING HOLE (JOINT-SIDE FIXING PORTION)
47 SLIDE GROOVE (JOINT-SIDE SLIDING PORTION)

48 SWITCH OPERATING MEMBER
49 SWITCH OPERATING PORTION
50L LEVER-MEMBER HANGING PORTION (LEVER-MEMBER SETTING PORTION)
50N LEVER-MEMBER HANGING PORTION (LEVER-MEMBER SETTING PORTION)

PUSH-BUTTON SWITCH

BACKGROUND OF THE INVENTION

1. Field of the Invention

The present invention relates to a push button switch used for an elevator switch and the like.

2. Description of the Related Art

FIGS. 33 and 34 show a conventional push button switch. The push button switch S-1 has a case 90 and a setting portion 100 is set to the case 90. Moreover, two fixed terminals 91 are set to the backs of opposite side faces of the case 90 and these fixed terminals 91 respectively have a fixed contact point at their upper faces.

Furthermore, an operating shaft 92 is movably set to the case 90, and a movable piece 93 is set to the inner end of the operating shaft 92 so that the fixed terminals 91 are faced each other and has a movable contact point 93*a* opposite to the fixed contact point 91*a*. Furthermore, a diffusion plate 95, character plate 94, and key top 96 are set to the outer end of the operating shaft 92 so that they are overlapped each other.

Furthermore, the operating shaft 92 is raised by a return spring 97 and the movable contact point 93*a* separates from the fixed contact point 91*a*.

A lamp 98 is set to a lamp holder 99. Then, by setting the case 90 to a setting destination member (not illustrated) while housing the lamp 98 and lamp holder 99 in the case 90, the push button switch S-1 is constituted. The push button switch S-1 uses a directly-under illumination system in which the lamp 98 is set directly under a push button portion constituted by the diffusion plate 95, character plate 94, and key top 96.

Moreover, by pushing in the key top 96 of the push button portion by a finger and thereby, pushing in the operating shaft 92 against the return spring member 97, the movable contact point 93*a* of the movable piece 93 contacts wit the fixed contact point 91*a* of the fixed terminal 91, the contact point closes, and the switch is turned on.

When the lamp 98 lights up, it illuminates the diffusion plate 95 from its back. Therefore, characters on the character plate 94 can be seen from the outside of the key top 96 by the light passing through the diffusion plate 95.

However, because the above conventional push button switch S-1 is constituted so as to push the key top 96, directly move the movable contact point 93*a*, close the contact point portion constituted by the movable contact point 93*a* and fixed contact point 91*a*, and turn on the switch. Therefore, the key top 96 requires a movement stroke equal to or more than a contact point gap necessary to open or close the contact point of the contact point portion, that is, the opening distance between the contact points 91*a* and 93 for the contact point portion to be safely turned off. Thus, there is a problem that the whole switch becomes thick.

SUMMARY OF THE INVENTION

The present invention is made to solve the above problems and its object is to provide a push button switch whose thickness can be decreased.

To achieve the above object, a push button switch of the present invention uses a push button switch in which a push button portion and a switch portion are housed in a case so as to open or close the switch portion by pushing in the push button portion, comprising a lever-link mechanism having a pair of lever members which rock about a rocking fulcrum by interlocking with the push button portion when the push button portion is pushed in and are arranged so as to be faced each other, in which the both lever members are connected each other so that they can be folded and slid at their facing ends faced each other and a switch operating member for opening or closing the switch portion when the lever link mechanism is rocked because the push button portion is pushed in.

In the case of the above configuration, by pushing in the push button portion, the push button portion is moved in parallel in its pushed direction by a lever link mechanism and when the lever ling mechanism is operated by pushing in the push button portion, lever members constituting the lever link mechanism are rocked about a rocking fulcrum and thereby, it is possible to operate a switch portion by a switch operating member.

A contact-point gap necessary to open or close the switch portion, that is, an opening distance between contact points for the switch portion to be safely turned off is different from the movement stroke of the push button portion. A movement stroke equal to or more than an opening distance between contact points for a contact portion to be safely turned off has been necessary for a push button portion (key top) so far. However, because the difference between a predetermined movement stroke of the push button portion and a stroke (contact point gap) necessary to open or close the contact point of a switch portion can be adjusted by selecting the lever ratio of a lever member, it is possible to securely operate the switch portion by a small movement stroke of the push button portion.

That is, to securely operate the switch portion by making the movement stroke of the push button portion smaller than the stroke (contact point gap) necessary to open or close the contact point of the switch portion, it is possible to decrease the thickness of the push button switch.

Thus, because the switch portion can be securely operated by making the movement stroke of the push button portion smaller than the stroke (contact point gap) necessary to open or close the switch portion, it is possible to decrease the thickness of the push button switch.

Particularly, because the lever link mechanism has a pair of lever members which rock about a rocking fulcrum and are connected each other so that they can be folded and slid at their facing ends, it is unnecessary to use an elevating link in which two links having been generally used are slidably connected each other at their intermediate portions and it is possible to decrease the thickness of a push button switch.

In this case, the push button portion is constituted by fitting a diffusion plate, character plate, and key top to an operating shaft while lapping them and fixing them to the operating shaft. Moreover, the switch portion corresponds to a tactile switch or mechanical switch serving as a built-in switch.

Moreover, in the case of the above push button switch of the present invention, a pair of lever members is constituted by a wire.

According to the above configuration, a pair of lever members becomes strong, it is tough in shock and it is not broken though a synthetic-resin lever member is weak in shock and it may be broken. Thus, it is possible to contribute to a long-term use of a push button switch.

Moreover, in the case of the above push button switch of the present invention, one lever member is fixed to one joint member at the faced end of one arm and the faced end of the other arm is slidably connected to the other joint member of the other arm, the other lever member is fixed to the other joint at the faced end of one arm, and the faced end of the other arm is slidably connected to one joint to form a lever folding point on a straight line connecting the faced end of the other arm of one lever member with the faced end of the other arm of the other lever member.

According to the above configuration, by pushing in a push button portion, it is possible to move the push button portion in parallel by a lever link mechanism in its pushed direction, rock one and the other lever members constituting the lever link mechanism about their respective rocking fulcrums when the push button portion is pushed in and thereby, the lever link mechanism operates, and joint-move the lever members at a lever folding point. Therefore, it is possible to easily exhibit the parallel-movement function of the lever link mechanism.

Moreover, it is possible to constitute a simple and low lever link mechanism and contribute to decrease of a push button switch in thickness.

Furthermore, in the case of the above push button switch of the present invention, a muffling member for generating a spring force in the direction opposite to the pushed direction of a push button portion when the push button portion is pushed in is set between a switch operating member and a switch portion.

According to the above configuration, because the muffing member is set between the switch operating member and switch portion, when the switch portion is pushed through the muffling member, a pushing force for the switch operating member to push the switch portion is added to the pushing force of the switch operating member. However, because the spring force of the muffling member acts in the direction opposite to the pushed direction of the switch portion, that is, the spring force of the muffling member acts so as to cancel the pushing force of the switch operating member, the collision speed of the movable contact point of the switch portion to the fixed contact point of the switch portion decreases, the collision load between the contact points decreases, and it is possible to eliminate a noise of "click" which is generated when the movable contact point contacts with the fixed contact point.

Moreover, in the case of the above push button switch of the present invention, an illuminating portion for illuminating the front of a push button portion is set to a case so as to cover a switch operating member.

According to the above configuration, it is possible to realize a low structure by lapping a switch operating member on an illuminating portion and it is possible to contribute to decrease of a push button switch in thickness.

In this case, the illuminating portion is constituted by a reflection case, light guiding portion held by the reflection case, and LED module serving as a light source for supplying light to the light guiding portion.

Moreover, in the case of the above push button switch of the present invention, an elastic stopper member with which a push button portion contacts when the push button portion is pushed in is set to a case.

According to the above configuration, when normally pushing the push button portion, the push button portion contacts with a stopper member and because the push button portion can withstand the pressure of the stopper, it is possible to prevent the pressure from influencing components.

Moreover, in the case of the above push button switch of the present invention, a shock absorbing member is set between a case and a clamp of the case.

According to the above configuration, when normally pushing the bush button portion, the bush button portion contacts with the stopper member and is able to withstand the pressure of the stopper member. However, when pushing the bush button at an excessive pressure, the bush button collides with the stopper member and thereby, the stopper member is deflected, the push button portion is supported by the case, and the case is supported by the shock absorbing member. Therefore, it is possible to prevent the push button switch from being broken due to the excessive pressure.

In this case, the shock absorbing member uses an elastic plate.

DESCRIPTION OF THE PREFERRED EMBODIMENTS

A push button switch (embodiment) of the present invention is described below by referring to the accompanying drawings.

Figure 1:
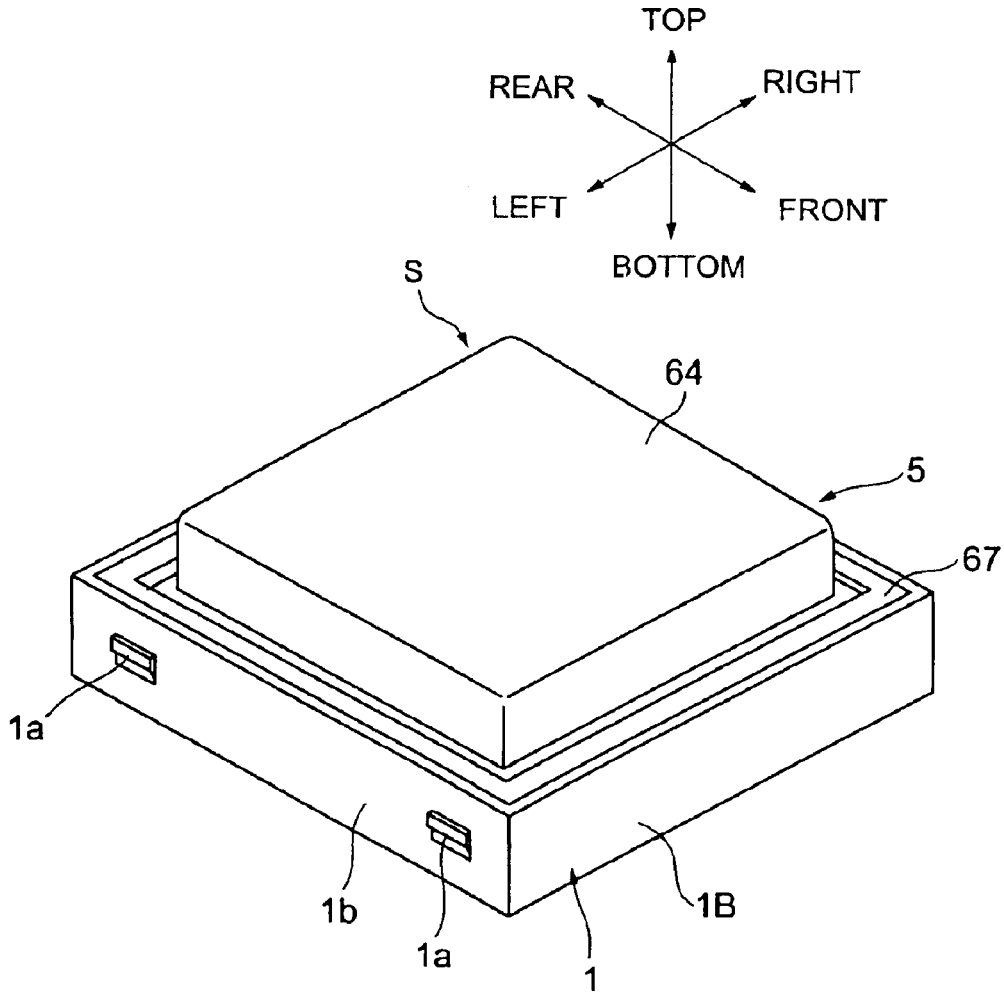
FIG. 1 is a perspective view of a push button switch according to an embodiment of the present invention.
Figure 2:
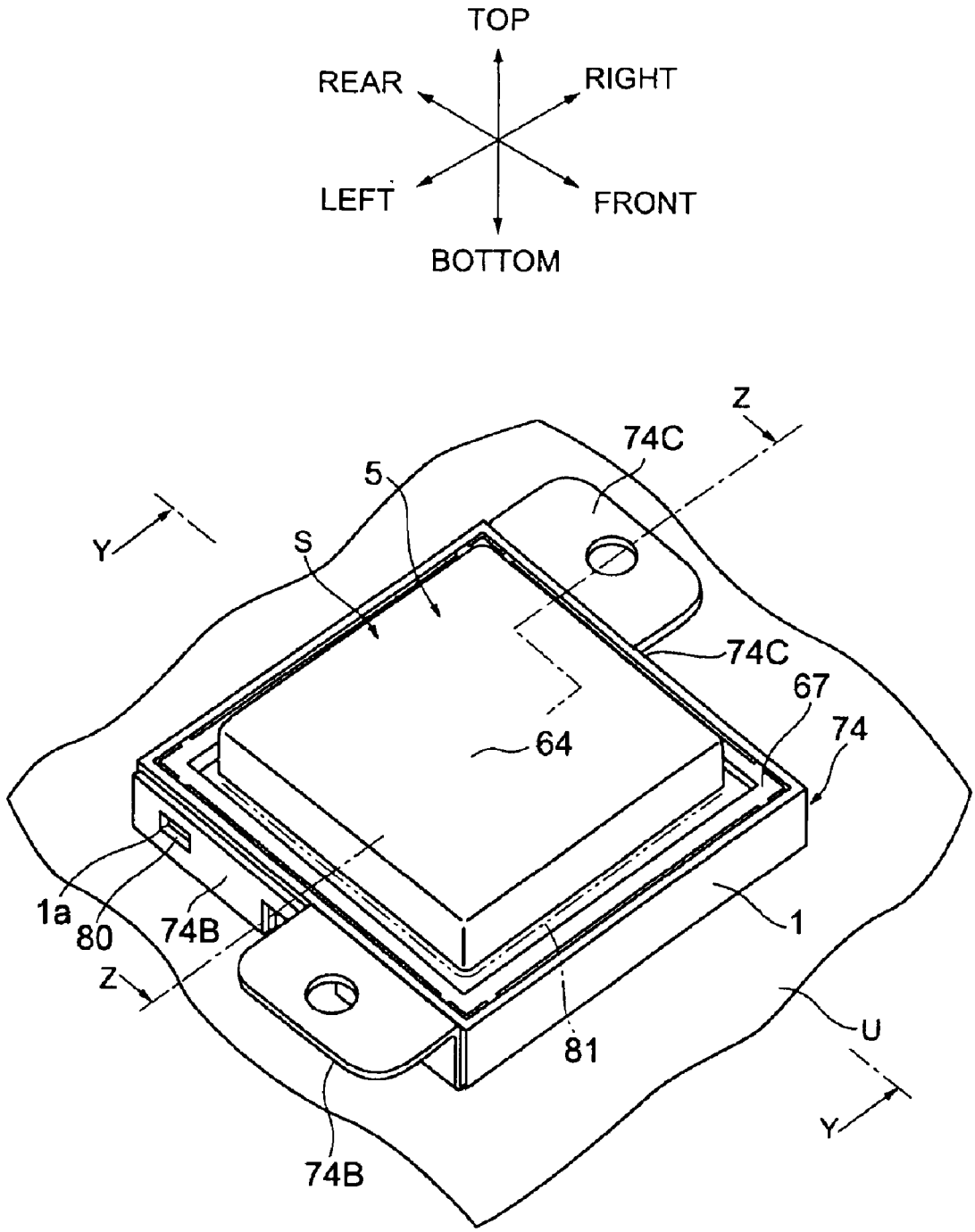
FIG. 2 is a perspective view of the push button switch in FIG. 1 while it is set to a clamp.
Figure 3:
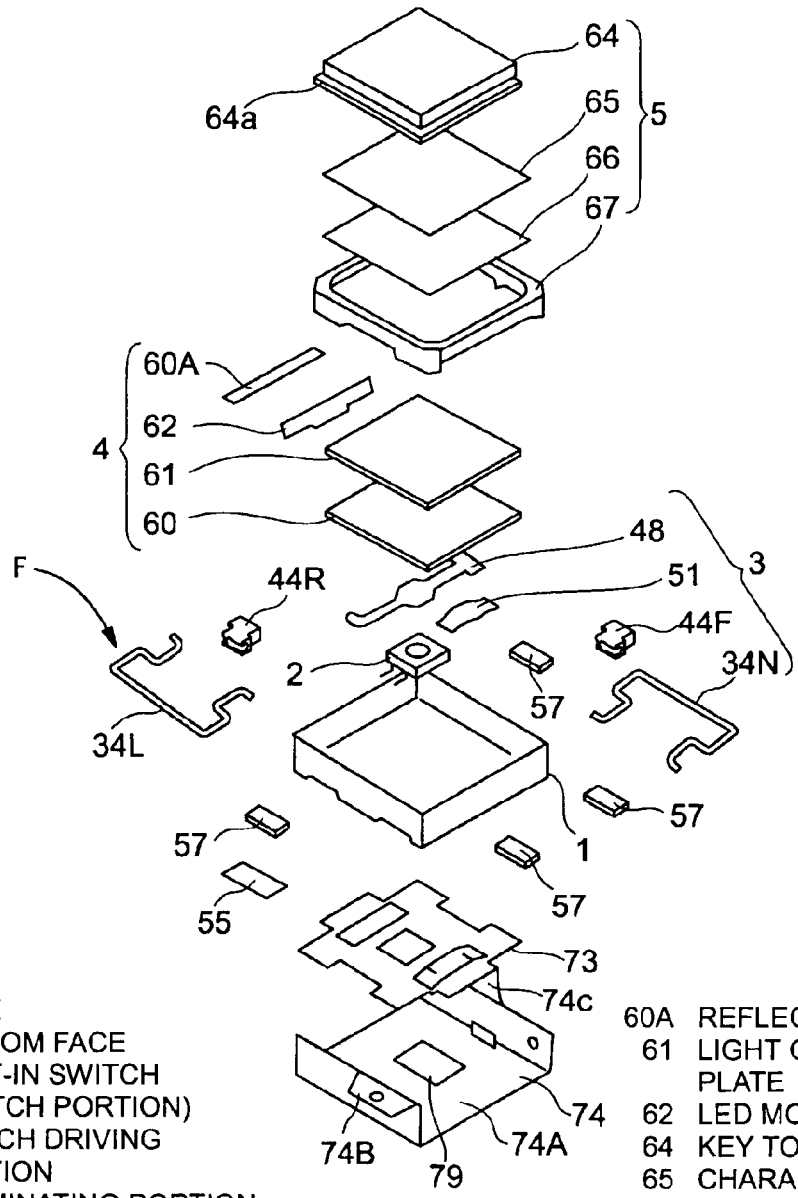
FIG. 3 is a schematic perspective view of the push button switch in FIG. 1 while it is disassembled.
Figure 4:
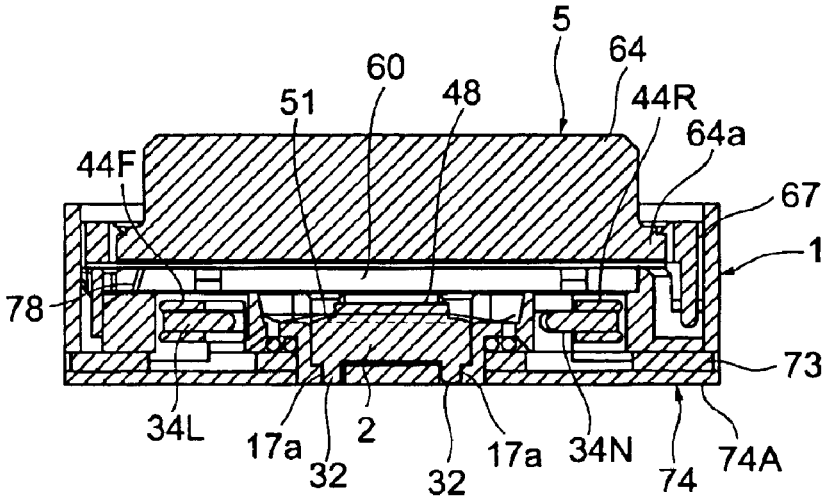
FIG. 4 is a sectional view taken along the line Y—Y in FIG. 2.
Figure 5:
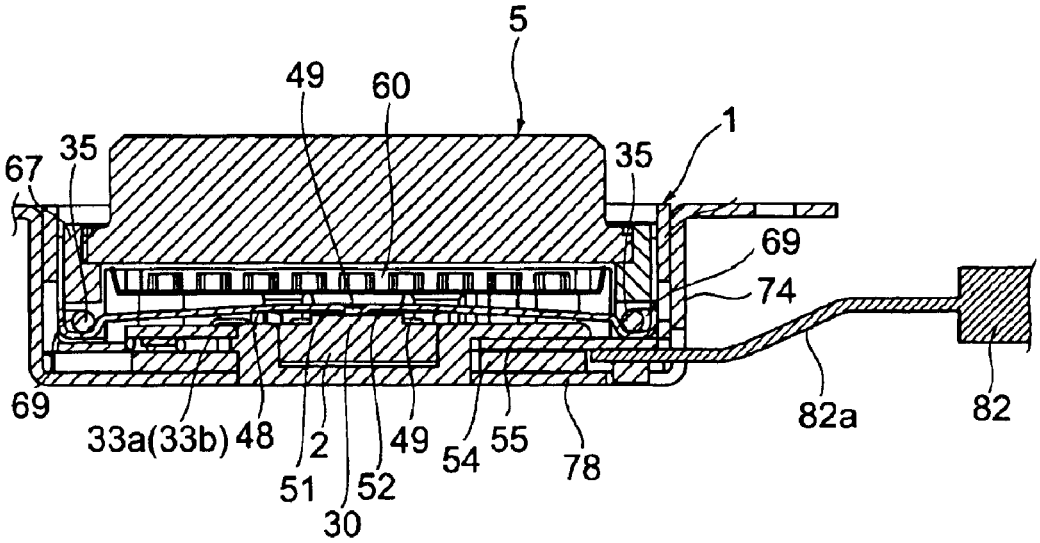
FIG. 5 is a sectional view taken along the line Z—Z in FIG. 2.

FIG. 1 is a perspective view of a push button switch of the present invention, FIG. 2 is a perspective view of the push button switch while it is set to a clamp, FIG. 3 is a schematic perspective view of the push button switch while it is disassembled, FIG. 4 is a sectional view taken along the line Y—Y in FIG. 2, and FIG. 5 is a sectional view taken along the line Z—Z in FIG. 2. For convenience sake of description, anteroposterior direction, horizontal direction, and vertical direction are set as illustrated.

As shown in FIGS. 1 to 3, an embodiment of a push button switch of the present invention has a case 1, a built-in switch 2 serving as a switch portion to be housed in the case 1, a switch driving portion 3 for operating the built-in switch 2 set in the case 1, an illuminating portion 4, and a push button portion 5.

Figure 10:
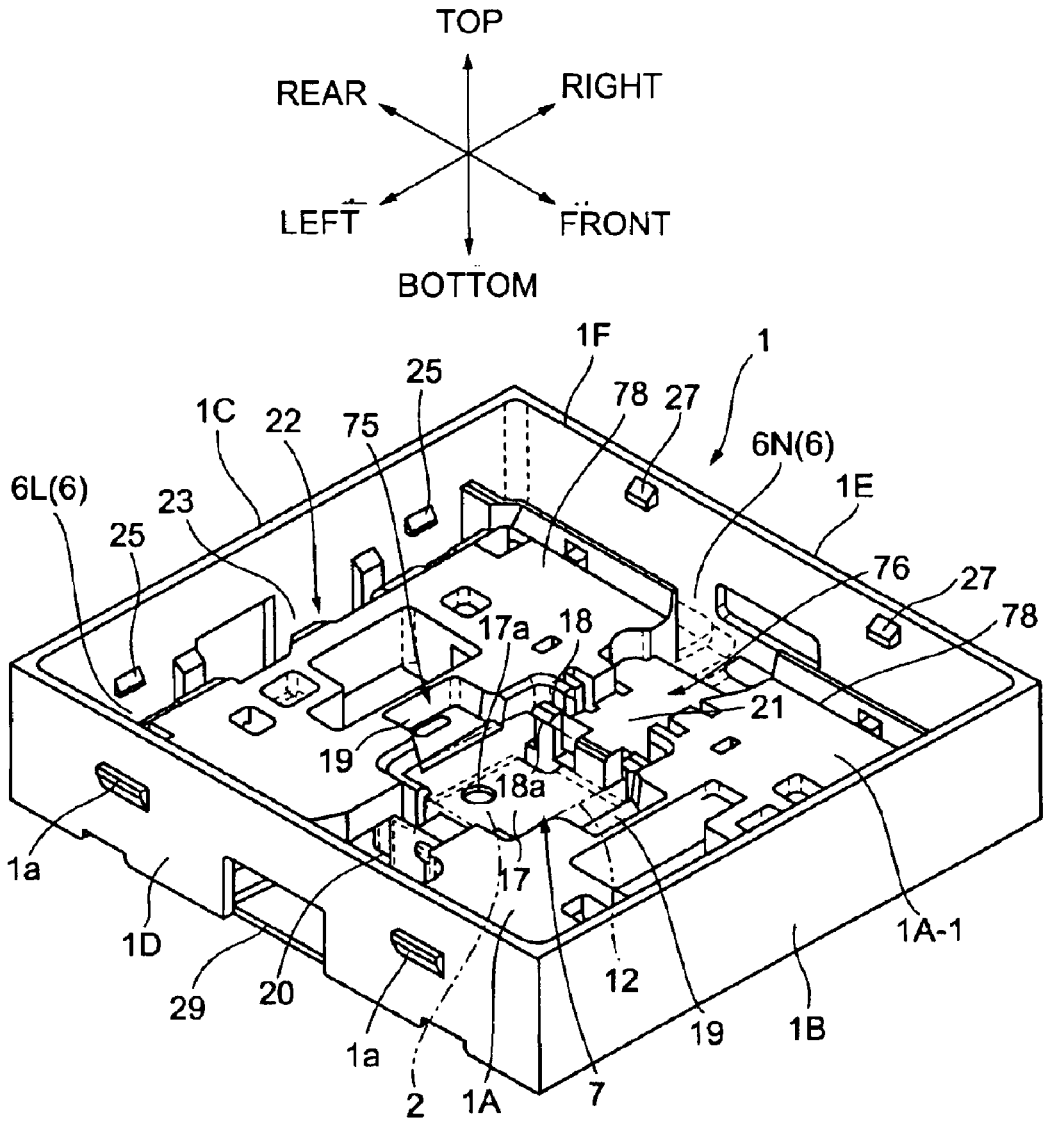
FIG. 10 is a perspective view of a case of the push button switch in FIG. 1.

As shown in FIG. 10, the case 1 has a case body 1F and the case body 1F is formed like a box having a bottom face (lower face) 1A, front and rear faces 1B and 1C, and left and right faces 1D and 1E and the upper face of the case body is open. Moreover, a securing protrusion 1*a* is formed on the left and right faces 1D and 1E respectively.

Figure 6:
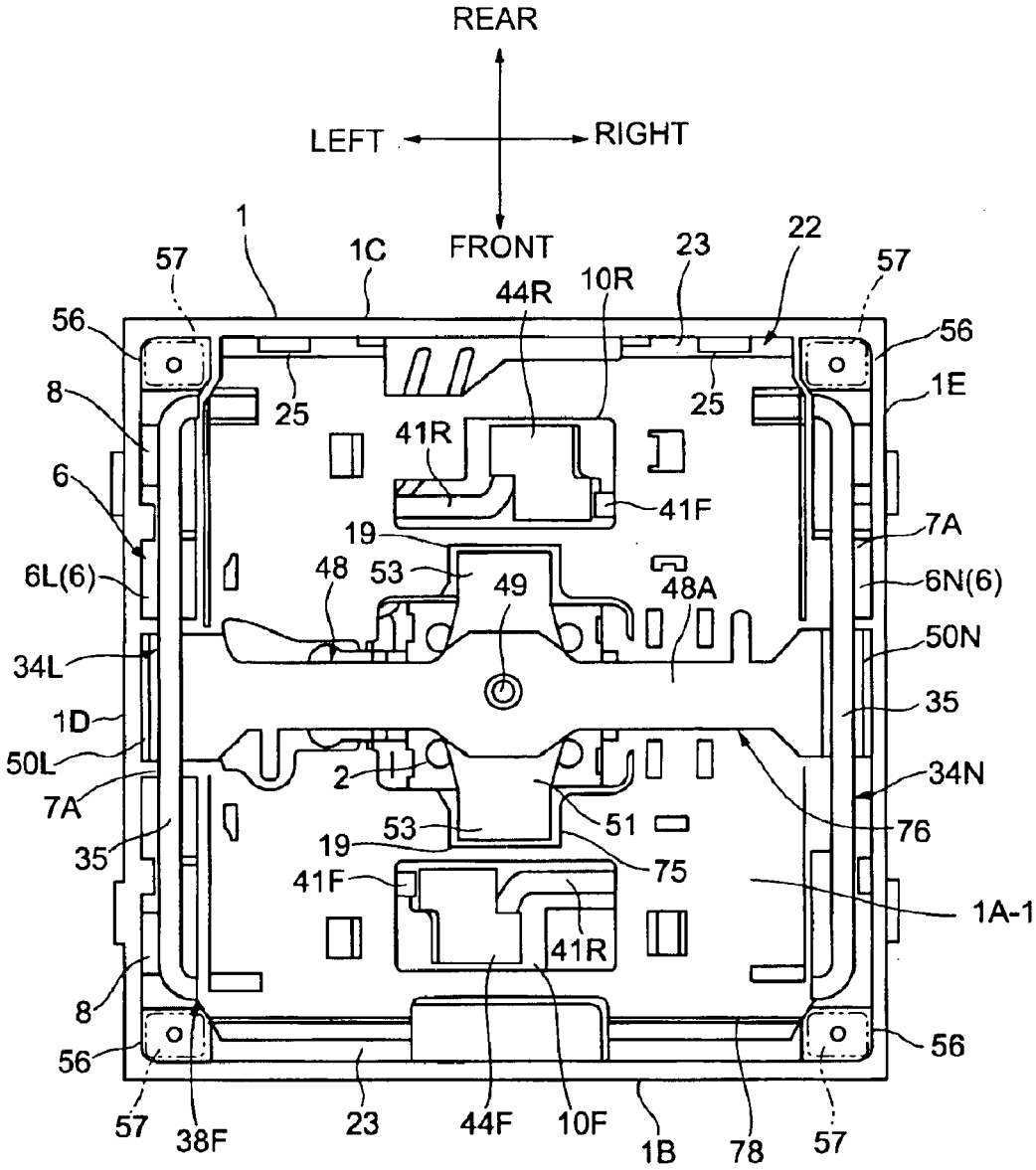
FIG. 6 is a top view of the push button switch in FIG. 1 while a push button portion and illuminating portion are removed.

Moreover, as shown in FIGS. 6 and 10, the following portions are formed on the inside 1A-1 of the bottom face 1A of the case body 1F: a lever-member setting portion 6, switch setting portion 7, muffling-member setting portion 75, switch-operating-member setting portion 76, operating-shaft setting portion 22, stopper-member setting portion 56, and reflection-case setting portion 78. Moreover, as shown in FIG. 11, a substrate setting portion 54 and a shock-absorption-member setting portion 77 are formed on the outside 1A-2 of the bottom face 1A.

The lever-member setting portion 6 is constituted by a left lever-member setting portion 6L serving as one lever-member setting portion and a right lever-member setting portion 6N serving as the other lever-member setting portion.

Figure 11:
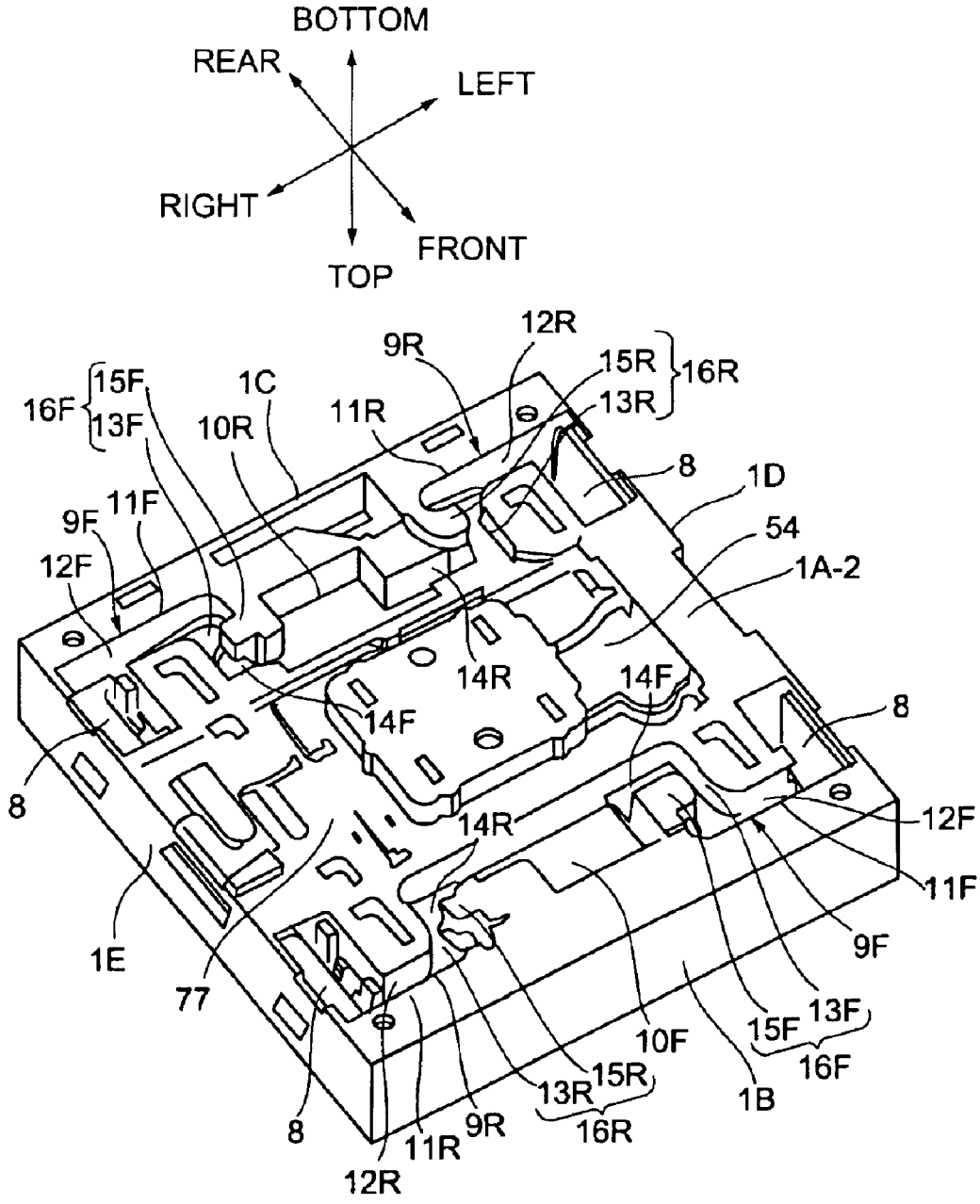
FIG. 11 is a perspective view of the push button switch in FIG. 1 when viewed from the back of the push button switch.

The left lever-member setting portion 6L is constituted by a lever-inserting long groove 7A formed along the left face 1D, a hole 8 formed at the front and rear of the lever-inserting long groove 7A respectively at the inside 1A-1 side of the bottom face 1A as shown in FIG. 6, and a lever-arm inserting grooves 9F and 9R formed at the front and rear at the outside 1A-2 side of the bottom face 1A and front and rear joint-member housings 10F and 10R serving as holes extending from the inside 1A-1 side to the outside 1A-2 side of the bottom face 1A as shown in FIG. 11.

The lever-arm inserting grooves 9F and 9R has crank-shaped grooves 11F and 11R formed on the outside 1A-2 of the bottom face 1A as shown in FIG. 11, the grooves 11*f* and 11R have horizontal grooves 12F and 12R connected to the hole 8 along the horizontal direction, vertical grooves 13F and 13R connected to the horizontal grooves 12F and 12R along the anteroposterior direction, horizontal grooves 14F and 14R connected to the vertical grooves 13F and 13R and connected to the joint-member housings 10F and 10R, and protrusions 15F and 15R are formed on the vertical grooves 13F and 13R to constitute front and rear lever fulcrum supports 16F and 16R.

Moreover, though the right lever-member setting portion 6N has the same configuration as the left lever-member setting portion 6L, the lever-arm inserting grooves 9F and 9R are formed in the reverse direction. Therefore, front and rear lever fulcrum supports 16F and 16R are formed in the reverse direction.

Furthermore, as shown in FIG. 10, the switch setting portion 7 is constituted by forming a securing hole 17*a* at the bottom of a concave portion 17 formed at the central portion of the inside 1A-1 side of the bottom face 1A and protrusively forming a cantilever-shaped securing portion 18 at four corners at the bottom of the concave portion 17. A pawl 18*a* is formed on the securing portion 18.

Furthermore, the stopper-member setting portion 56 is formed at four corners of the inside 1A-1 of the case 1 as shown in FIG. 6.

Furthermore, the switch-operating-member setting portion 76 is constituted by forming a hole 20 and a concave portion 21 at the both sides of the concave portion 17 of the switch setting portion 7 as shown in FIG. 10. The hole 20 is connected to the lever-inserting long groove 7A of the left lever-member setting portion 6L and the concave portion 21 is connected to the lever-inserting long groove 7A of the right lever-member setting portion 6N.

Furthermore, the operating-shaft setting portion 22 is formed along insides of the front and rear faces 1B and 1C and left and right faces 1D and 1E of the case body 1F as shown in FIG. 10 and the front and rear of the portion 22 are formed as grooves 23. Furthermore, a pair of securing protrusions 25 is formed on insides of the front and rear faces 1B and 1C. Furthermore, a pair of guiding protrusions 27 is formed on insides of the left and right faces 1D and 1E.

Furthermore, a rectangular lead-wire hole 29 is formed from the bottom face 1A of the case body 1F up to the left face 1D.

Figure 15:
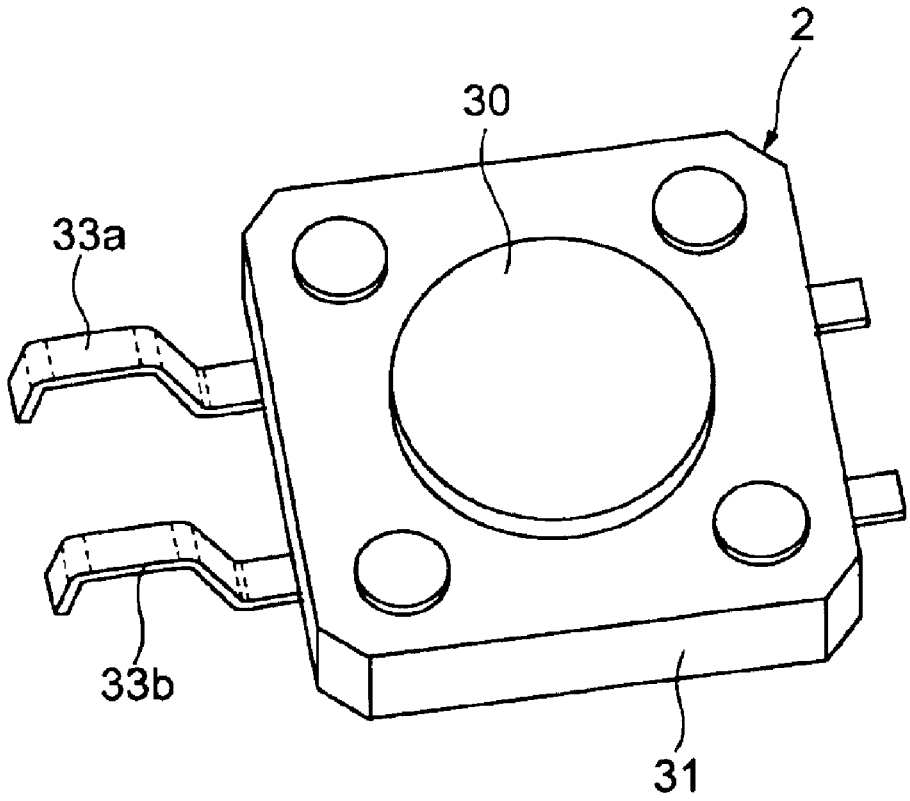
FIG. 15 is a perspective view of a built-in switch.

The built-in switch 2 is constituted by a tactile switch as shown in FIG. 15, which deflects a built-in movable electrode (not illustrated) constituted by a dome-shaped spring material by pushing a push button 30 serving as an external operating portion, turns on the movable electrode by bringing a movable contact point (not illustrated) of the movable electrode into contact with a fixed contact point (not illustrated), restores the movable electrode by its return force, and turns off the movable electrode. A securing protrusion 32 is protrusively formed on the back of a case 31 of the built-in switch 2 (refer to FIG. 8) and terminal leads 33*a* and 33*b* are set to side faces of the case 31.

Figure 8:
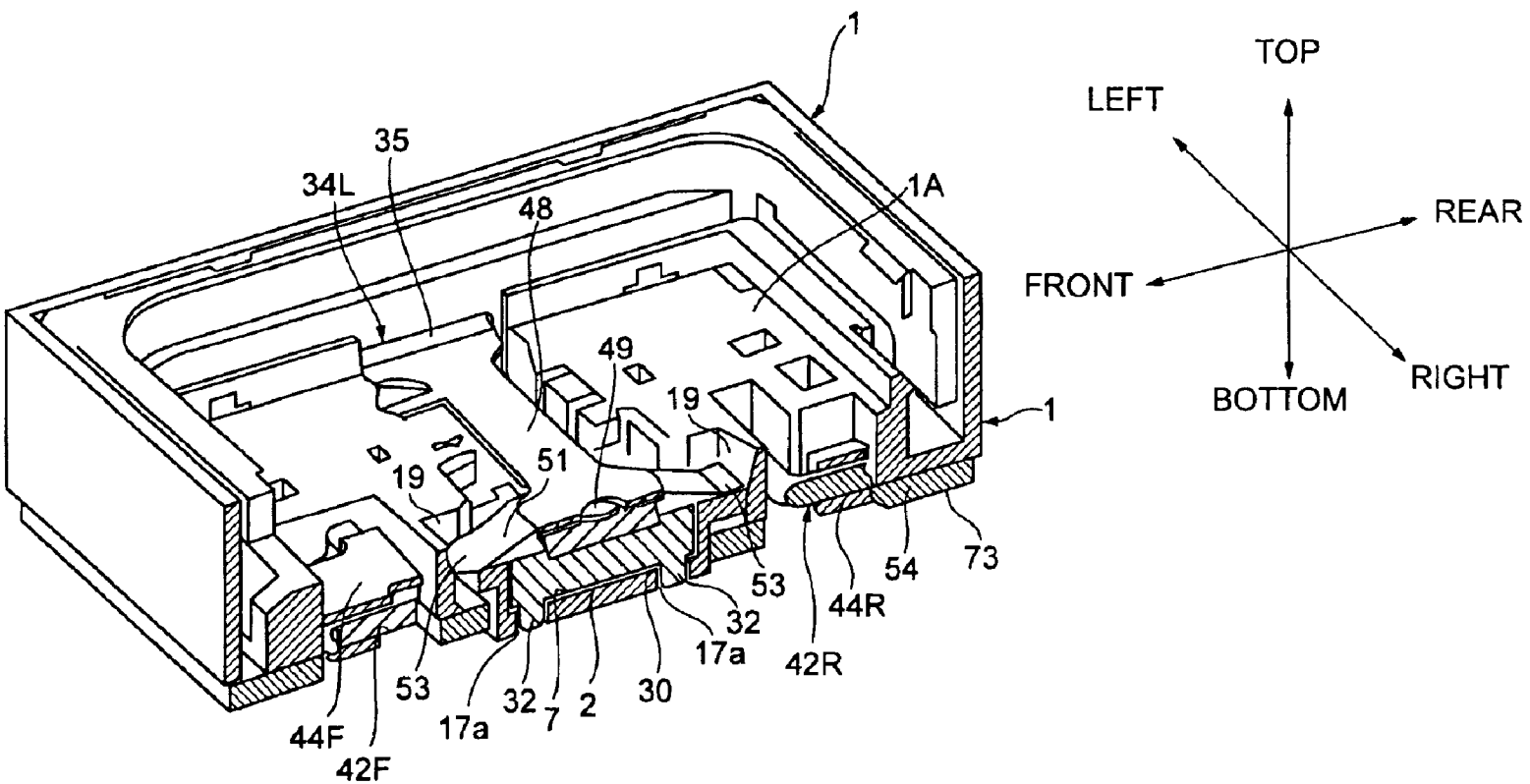
FIG. 8 is a perspective view of the push button switch in FIG. 1 while a push button portion and illuminating portion are removed and the push button switch is sectioned.

Moreover, the built-in switch 2 is set to the switch setting portion 7 by inserting and securing the securing protrusion 32 into and at the securing hole 17*a* of the switch setting portion 7 as shown in FIG. 8 and securing the pawl 18*a* of the securing portion 18 at the shoulder of the case 31 as shown by a virtual line in FIG. 10. Furthermore, a printed circuit board 55 is set to the substrate setting portion 54 formed at the outside 1A-2 side of the bottom face 1A of the case 1 as shown in FIG. 5 and the terminal leads 33*a* and 33*b* of the built-in switch 2 are connected to the printed circuit board 55.

As shown in FIG. 3, the switch driving portion 3 has left and right (one and the other) lever members 34L and 34N, joint members 44F and 44R for connecting the lever members 34L and 34N each other, a movable-piece-shaped switch operating member 48 made of an elastic material (spring-plate material), and a muffling member 51 formed by a leaf spring. Moreover, left and right lever members 34L and 34N and the joint members 44F and 44R constitute a lever link mechanism F (refer to FIG. 12).

Figure 12:
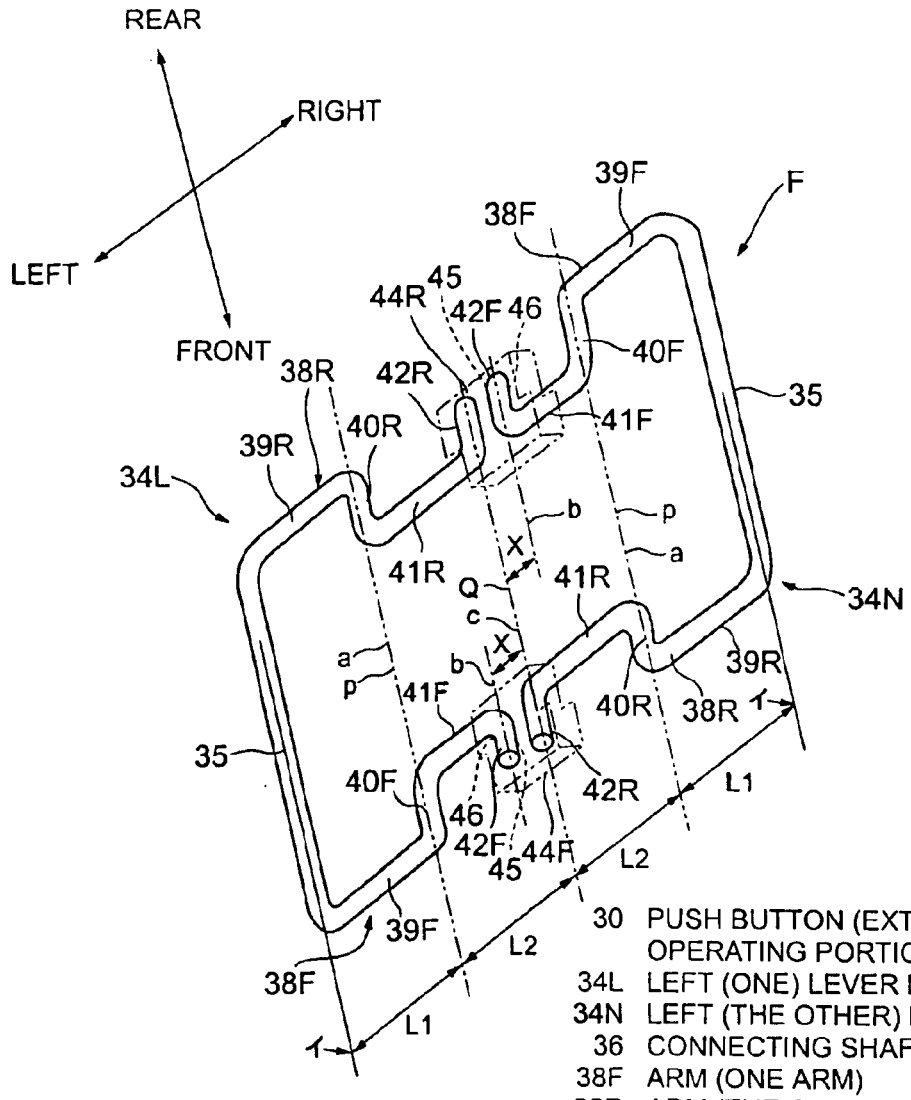
FIG. 12 is a perspective view of a lever member.

The left (one) lever member 34L is formed by bending a metallic wire as shown in FIG. 12. That is, the lever member 34L has a linear connecting shaft 35, an arm portion 38F serving as one arm bent and formed into a crank shape at the both ends of the connecting shaft 35, and an arm 38R serving as the other arm bent and formed into a crank shape at the rear end of the connecting shaft 35.

Moreover, the arm 38F has a connecting portion 39F orthogonal to the connecting shaft 35, a support 40F connected to the connecting portion 39F and parallel with the connecting shaft 35, a connecting portion 41F connected to the support 40F and orthogonal to the connecting shaft 35, and a pin portion 42F connected to the connecting portion 41F, parallel with the connecting shaft 35, and serving as one lever-side fixing portion.

Furthermore, the arm 38R has a connecting potion 39R orthogonal to the connecting shaft 35, a support 40R connected to the connecting portion 39R and parallel with the connecting shaft 35, a connecting portion 41R connected to the support 40R and orthogonal to the connecting shaft 35, and pin portion 42R connected to the connecting portion 41R, parallel with the connecting shaft 35, and serving as one lever-side rocking portion.

Furthermore, the supports 40F and 40R of the arms 38F and 38R are located on a parallel line "a" parallel with the connecting shaft 35, the connecting portion 41F is made shorter than the connecting portion 41R, and the axis line "b" of the pin portion 42F is displaced from the axis line "c" of the pin portion 42R by a dimension "x".

Furthermore, the right (the other) lever member 34N is constituted the same as the left (one) lever member 34L is. Furthermore, the right lever member 34N is faced with the left lever member 34L by rotating a lever member same as the left lever member 34L by 180° in the horizontal direction, the pin portion 42F of the arm 38F serving as one arm of the right lever member 34N becomes the other lever-side fixing portion, and the pin portion 42R of the arm portion 38R serving as the other arm portion becomes the other lever-side sliding portion. The sliding portion is provided with the same symbol as the left lever member 34L and its description is omitted.

Figure 13:
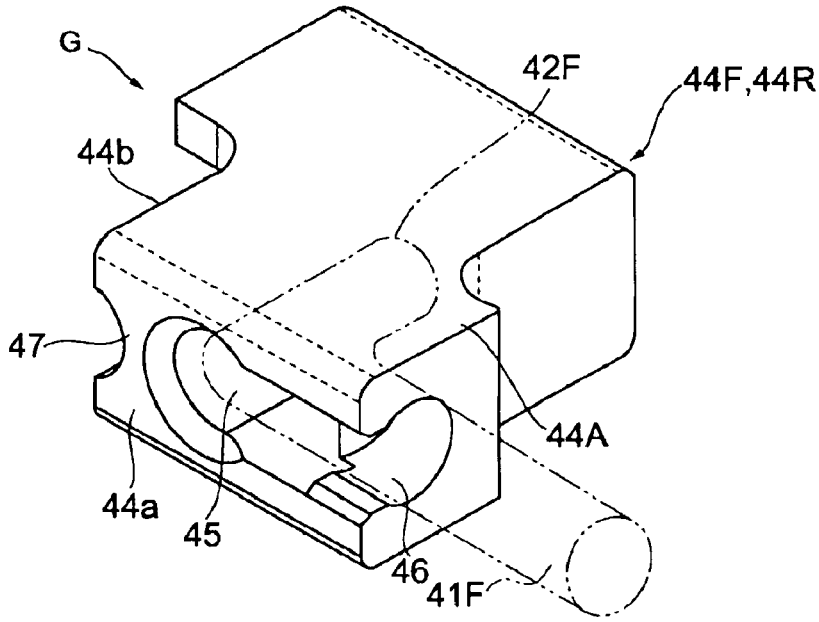
FIG. 13 is a perspective view of a joint member.
Figure 14:
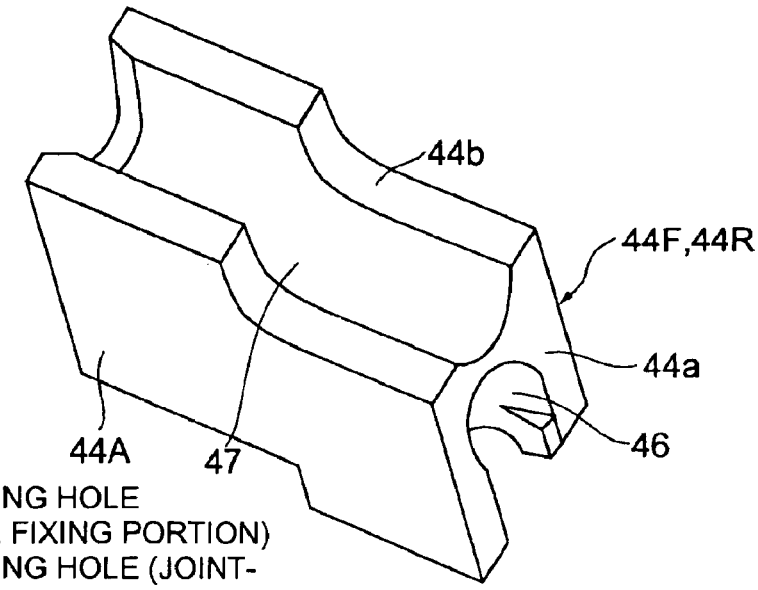
FIG. 14 is a perspective view of the joint member in FIG. 13 when viewed from the direction G in FIG. 13.

The joint members 44F and 44R have a block-shaped member body 44A as shown in FIGS. 13 and 14, a pin inserting hole 45 is formed on the inside 44*a* of the member body 44A vertically to the inside 44*a* and moreover, a pin inserting groove 46 connected to the pin inserting hole 45 is formed on the inside 44*a*, and the hole 45 and groove 46 constitute a joint fixing portion. Moreover, a slide groove potion 47 serving as a joint-side sliding portion parallel with the pin-inserting-hole potion 45 is formed on an end face 44*b* orthogonal to the inside 44*a* of the member body 44A.

Figure 16:
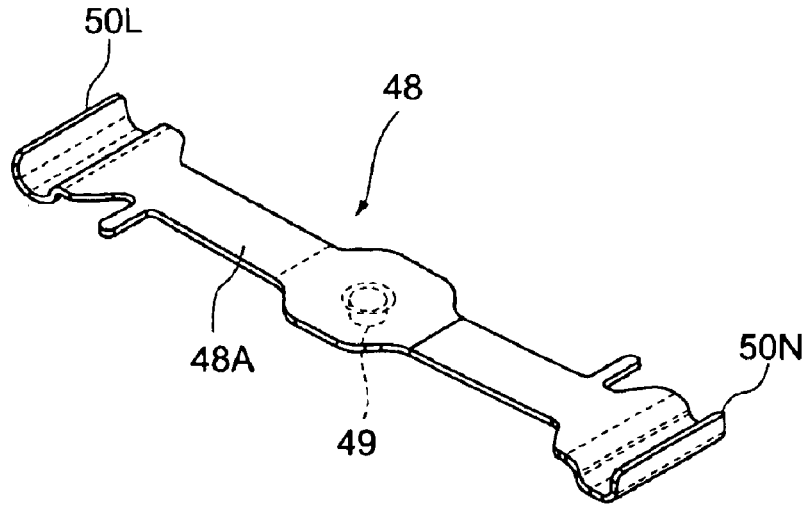
FIG. 16 is a perspective view of a switch operating member.

The switch operating member 48 has a strip plate 48A formed by a metal leaf as shown in FIG. 16 and a protruded switch operating portion 49 is formed at the central portion of the plate 48A. Moreover, lever member hangings 50L and 50N serving as lever-member setting portions are formed at the both ends of the plate port 48A.

Figure 17:
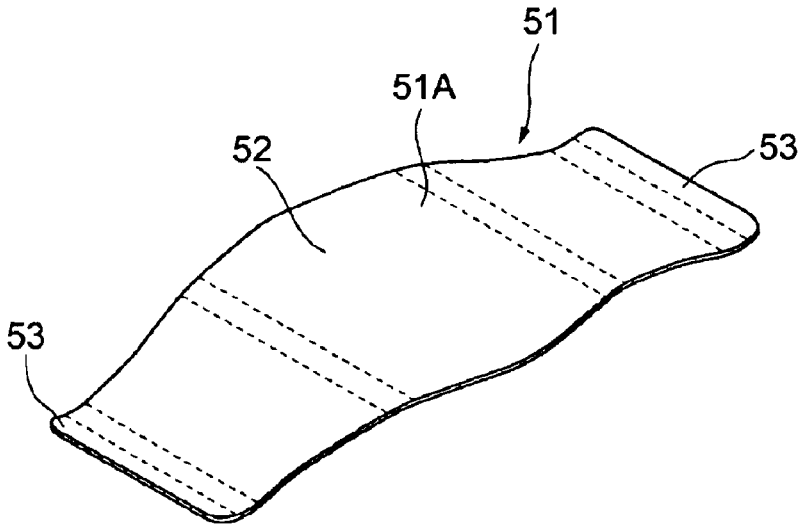
FIG. 17 is a perspective view of a muffling member.

As shown in FIG. 17, the muffling member 51 has a strip plate 51A formed by a metal leaf as shown in FIG. 17 and the central portion of the plate 51A is formed as a switch contact portion 52 and the both ends of the plate 51A are formed as supports 53.

Moreover, as shown in FIGS. 12 and 13, the joint member 44F is set to the left (one) lever member 34L by inserting the pin portion 42F of the arm 38F of the member 34L into the pin inserting hole 45 of the joint member 44F and the connecting portion 41F into the pin inserting groove 46 and the joint member 44R is set to the right (the other) lever member 34N by inserting the pin portion 42F of the arm 38F of the member 34N into the pin inserting hole 45 of the joint member 44R and the connecting portion 41F into the pin inserting groove 46.

Furthermore, the left lever member 34L is set to the left-side lever-member setting portion 6L of the case 1 and the right lever member 34N is set to the right-side lever-member setting portion 6N of the case 1 and the left and right lever members 34L and 34N are flexibly connected each other by the joint members 44F and 44R.

Figure 7:
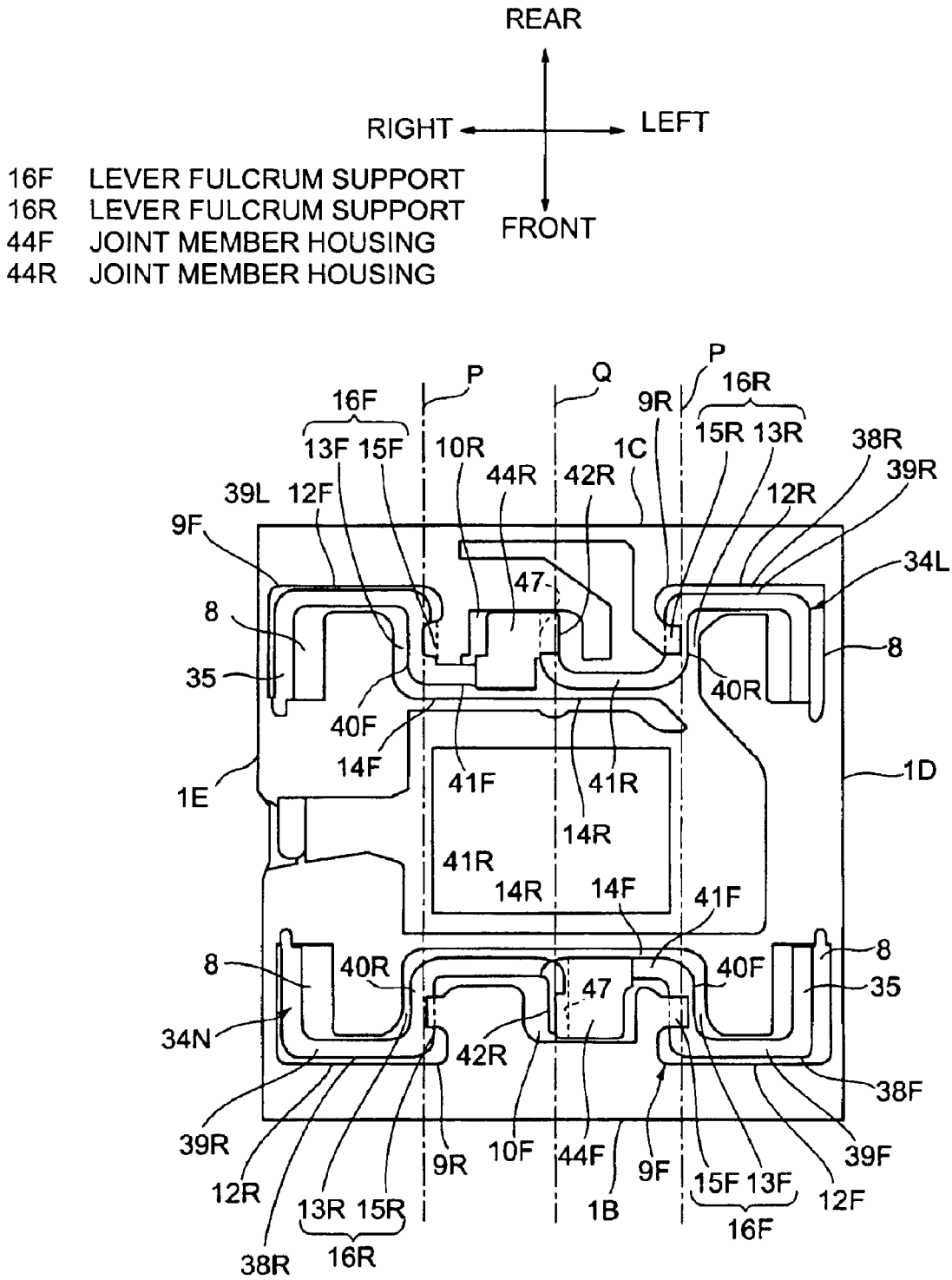
FIG. 7 is a top view of the push button switch in FIG. 1 when viewed from the back of the push button switch.

That is, the connecting shaft 35 of the left lever member 34L is inserted into the left lever-inserting long groove 7A of the case 1 as shown in FIG. 6 and the arm 38F of the left lever member 34L is inserted into the lever-arm inserting-groove 9F of the case 1 as shown in FIG. 7. In this case, the connecting portion 39F of the arm 38F is inserted into the horizontal groove 12F of the lever-arm inserting groove 9F, the support 40F is inserted into the lever fulcrum support 16F, and the connecting portion 41F is inserted into the horizontal groove 14F. Moreover, the joint member 44F is housed in the joint member housing 10F.

Furthermore, as shown in FIG. 7, the arm 38R of the left lever member 34L is inserted into the lever-arm inserting groove 9R of the case 1. In this case, the connecting portion 39R of the arm 38R is inserted into the horizontal groove 12R of the lever-arm inserting groove 9R, the support 40R is inserted into the lever fulcrum support 16R, and the connecting portion 41R is inserted into the horizontal groove 14R. Furthermore, the supports 40F and 40R constitute the rocking fulcrum P of the left lever member 34L.

Furthermore, the connecting shaft 35 of the right lever member 34N is inserted into the right lever inserting groove 7A of the case 1 as shown in FIG. 6 and the arm 38R of the right lever member 34N is inserted into the lever-arm inserting groove 9R of the case 1 as shown in FIG. 7. In this case, the connecting portion 39R of the arm 38R is inserted into the horizontal groove 12R of the lever-arm inserting groove 9R, the support 40R is inserted into the lever fulcrum support 16R, and the connecting portion 41R is inserted into the horizontal groove 14R. Moreover, the joint member 44R is housed in the joint member housing 10R.

Furthermore, the arm 38F of the right lever member 34N is inserted into the lever-arm inserting groove 9F of the case 1. In this case, the connecting portion 39F of the arm 38F is inserted into the horizontal groove 12F of the lever-arm-inserting groove 9F and the support 40F is inserted into the lever fulcrum support 16F, and the connecting portion 41F is inserted into the horizontal groove 14F. Furthermore, the supports 40F and 40R form the rocking fulcrum P of the right lever member 43N.

Furthermore, the pin portion 42R of the left lever member 34L is slidably inserted into the slide groove 47 of the joint member 44R and the pin portion 42R of the right lever member 34N is slidably inserted into the slide groove 47 of the joint member 44R. A lever folding point Q for the left and right lever members 34L and 43N is located on a straight line connecting the pin portion 42R of the left lever member 34L with the pin portion 42R of the right lever member 34N (refer to FIG. 7).

Furthermore, as shown in FIG. 4, a muffling member 51 is set to a reflection member setting portion 75 by setting the support 53 of the member 51 to the concave portion 19 of the reflection member setting portion 75 of the case 1 while bringing the switch contact portion 52 at the central portion of the member 51 into contact with the push button 30 of the built-in switch 2.

Furthermore, the switch operating member 48 is located at the switch-operating-member setting portion 76 by hanging the left lever-member hanging portion 50L on the connecting shaft 35 of the left lever member 34L and the right lever-member hanging portion 50N on the connecting shaft 35 of the right lever member 34N as shown in FIG. 6 while bringing the protruded switch operating portion 49 of the member 48 into contact with the switch contact portion 52 of the muffling member 51.

Figure 22:
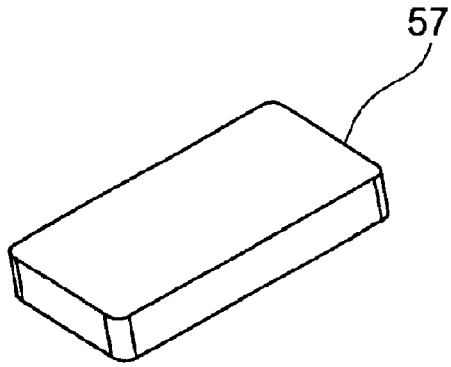
FIG. 22 is a perspective view of a stopper member.
Figure 23:
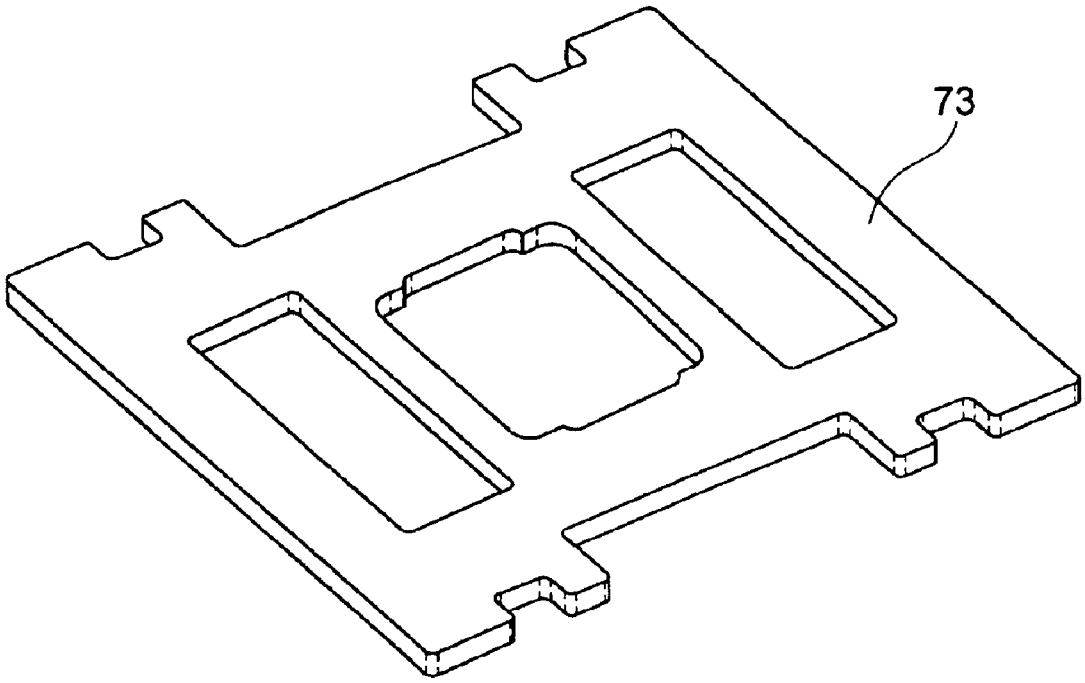
FIG. 23 is a perspective view of a shock absorbing member.
Figure 24:
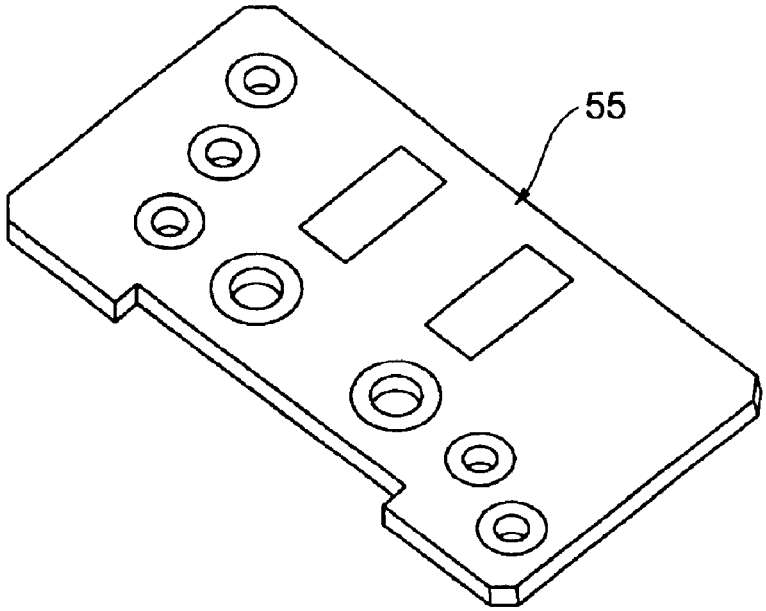
FIG. 24 is a perspective view of a printed circuit board.

Furthermore, a stopper member 57 made of an elastic material shown in FIG. 22 is set to the stopper-member setting portion 56 formed on the inside 1A-1 of the bottom face 1A of the case 1.

Figure 18:
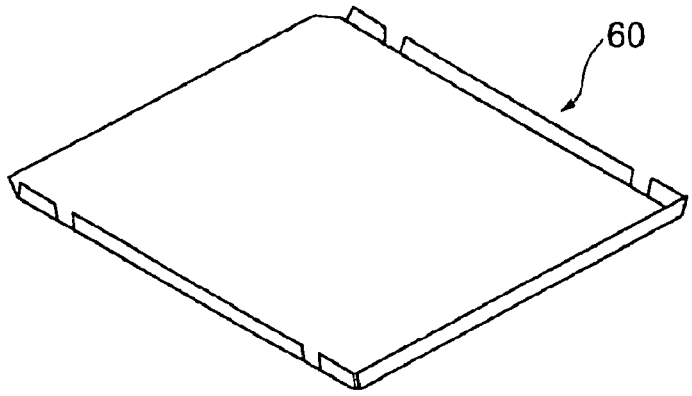
FIG. 18 is a perspective view of a reflection case.
Figure 19:
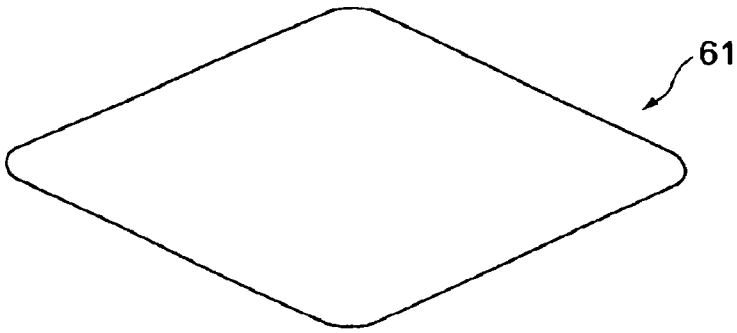
FIG. 19 is a perspective view of a light guiding plate.
Figure 20:
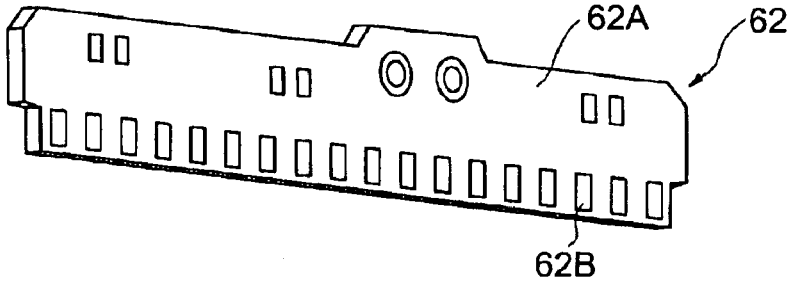
FIG. 20 is a perspective view of an LED module.

The illuminating portion 4 is constituted by a reflection case 60 serving as a reflection member shown in FIG. 18, a reflection plate 60A serving as a reflection member shown in FIG. 3, a light guiding plate 61 serving as a light guiding member shown in FIG. 19, and an LED module 62 serving as a light source shown in FIG. 20.

Moreover, the LED module 62 is set to the side end of the reflection case 60. The LED module 62 is constituted by horizontally arranging a plurality of LEDs 62B on a setting substrate 62A and each LED 62B faces the side end of the light guiding plate 61. Furthermore, the light guiding plate 61 is housed in the reflection case 60.

Furthermore, the reflection case 60, reflection plate 60A, light guiding plate 61, and LED module 62 formed into a unit are set to the reflection-case setting portion 78 of the case 1 by turning the reflection case 60 downward as shown in FIG. 4.

The push button portion 5 is constituted by a key top 64 made of a transparent resin, character plate 65, diffusion plate 66, and operating shaft 67. A securing portion 64*a* is formed around the key top 64 as shown in FIG. 3.

Figure 21:
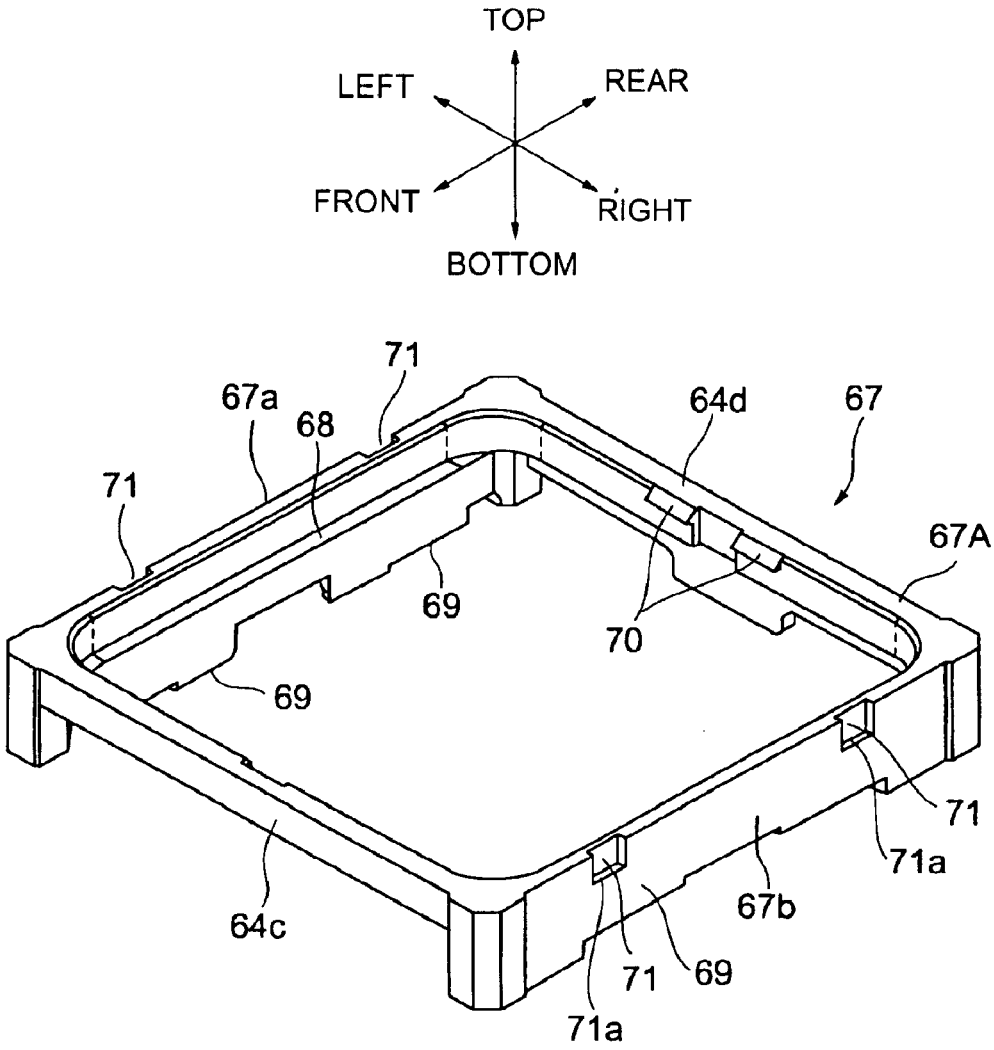
FIG. 21 is a perspective view of an operating shaft.

As shown in FIG. 21, the operating shaft 67 has a quadrangular-frame-shaped shaft body 67A, and a bush-button catching portion 68 is formed on insides of left and right faces 67*a* and 67*b* of the shaft body 67A and a sliding groove 71 is formed on outer fades of the left and right faces 67*a* and 67*b* from upper margins of the outsides downward.

Moreover, a lever contact portion 69 is formed at lower ends of the left and right faces 67*a* and 67*b* of the shaft body 67A. Furthermore, a securing portion 70 is formed at upper margins of insides of front and rear faces 64*c* and 64*d* of the shaft body 67A.

Furthermore, the diffusion plate 66 and character plate 65 are overlapped and housed in the operating shaft 66 to catch the character plate 65 and diffusion plate 66 by the push-button catching portion 68. Furthermore, by inserting the key top 64 into the operating shaft 67 and securing the securing portion 70 of the operating shaft 67 at the securing portion 64*a* of the key top 64, the key top 64, character plate 65*a*, and operating shaft 67 are formed into a unit.

Furthermore, the operating shaft 67 thus formed into the unit is inserted into the case 1, guiding protrusions 27 of the left and right faces 1D and 1E of the case 1 are slidably inserted into the sliding groove 71 on the outside of the left and right faces 67*a* and 67*b* of the operating shaft 67, and the lever contact portion 69 formed on the operating shaft 67 is rotatably brought into contact with the connecting shaft 35 of the left and right lever members 34L and 34N as shown in FIG. 5.

In this case, the resilience of a movable electrode formed by the spring material of the built-in switch 2 raises the push button 30 of the built-in switch 2, raises the muffling member 51 and movable piece 48 along the push button 30, and moreover raises the bush button portion 5.

Therefore, the guide protrusion 27 of the case 1 is hooked on the lower end 71*a* of the sliding groove 71 of the operating shaft 67 and the operating shaft 67 corresponds to pushing-up by the resilience of the movable electrode to hold the pushing-down stroke of the push button portion 5.

Figure 26:
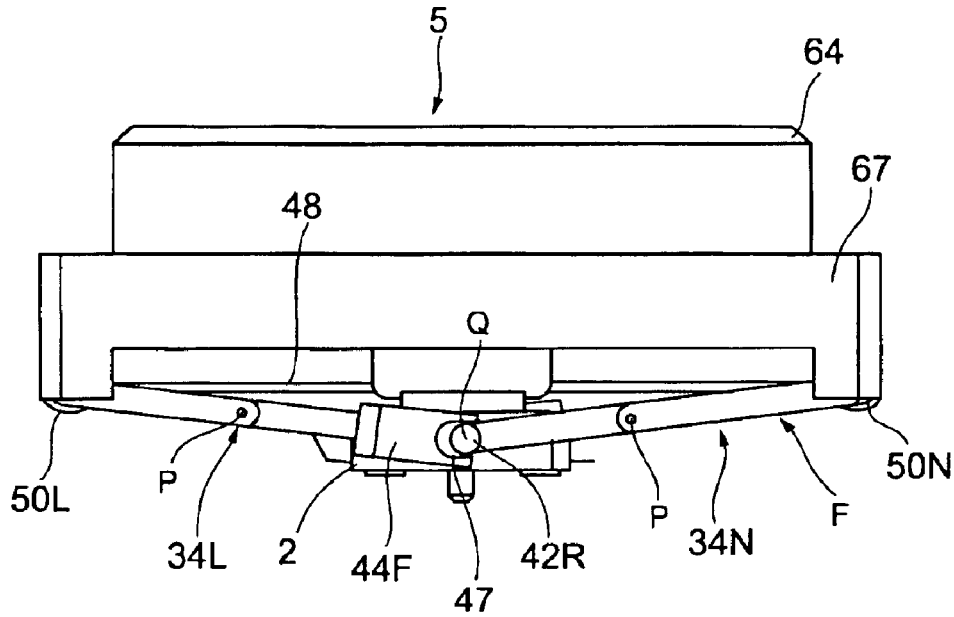
FIG. 26 is an illustration for explaining the behavior of a lever member before a push button portion is pushed.

Moreover, because the muffling member 51 and switch operating member 48 are pushed up by the push button 30, the left lever member 34L rotates about its rocking fulcrum clockwise as shown in FIG. 26, the right lever member 34N rotates about its rocking fulcrum counterclockwise as shown in FIG. 26, and the lever folding point Q of the left and right lever members 34L and 34N is lowered.

Figure 9:
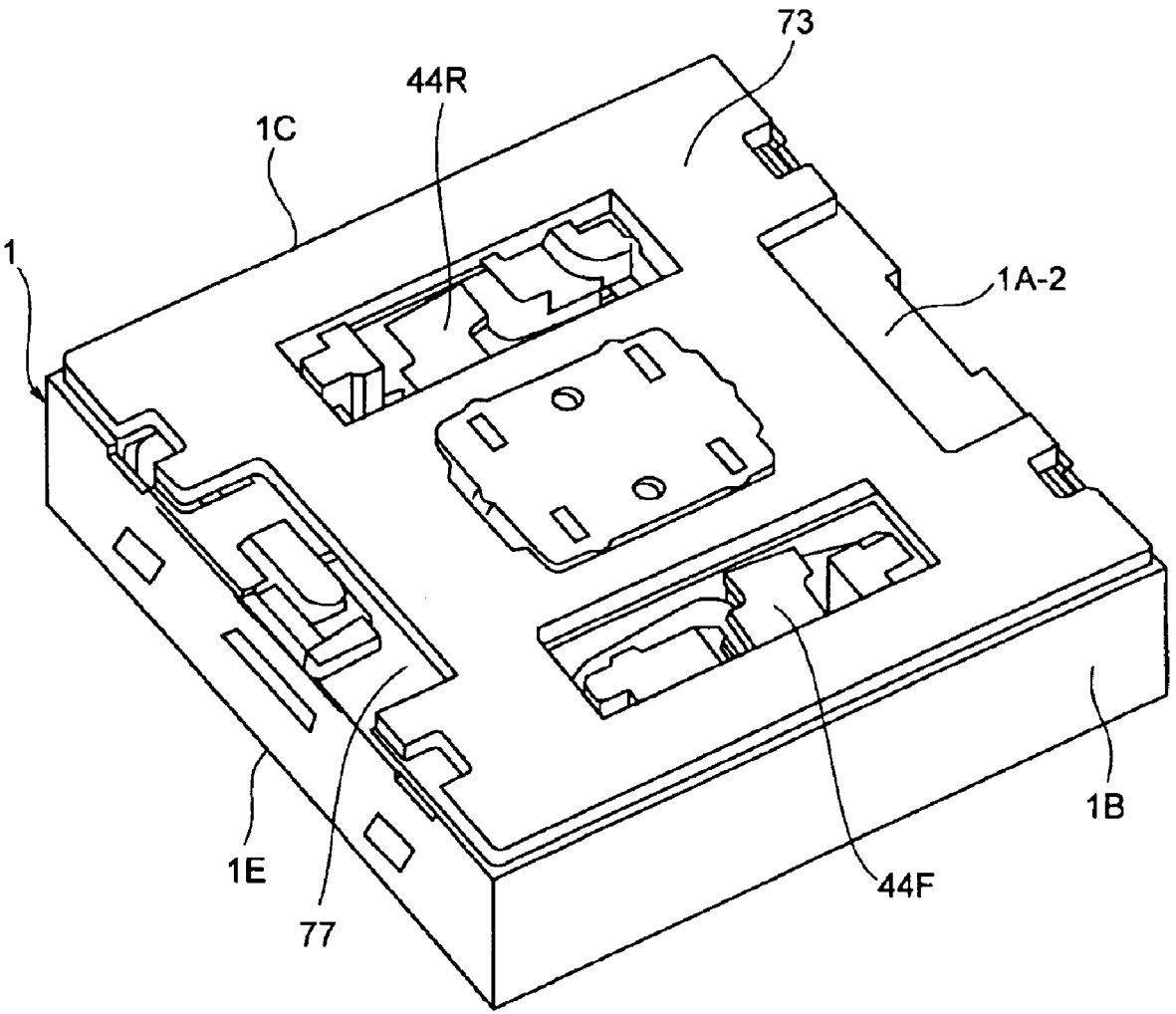
FIG. 9 is a perspective view of the push button switch in FIG. 1 while a sock absorbing member is set to the back of the push button switch.

Therefore, as shown in FIG. 9, in the push button switch S constituted as described above, a flat shock absorbing member 73 made of an elastic material is set to the shock-absorption-member setting portion 77 of the outer face 1A-2 of the case 1.

Figure 25:
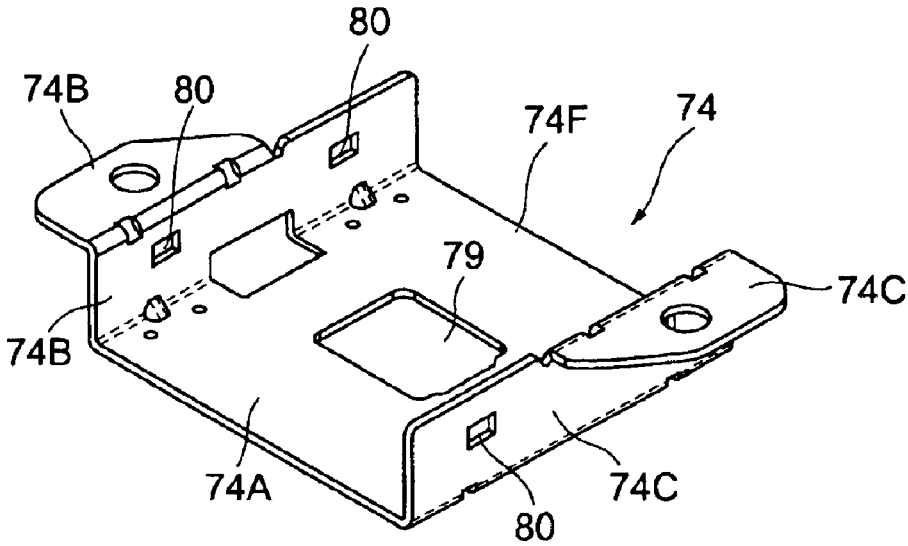
FIG. 25 is a perspective view of a clamp.

As shown in FIG. 25, a clamp 74 has-a clamp body 74F constituted by forming vertical walls 74B and 74C on left and right margins and setting portions 74B and 74C on left and right vertical walls 74B and 74C on a face 74A, in which an opening 79 is formed on the face 74A and a securing hole 80 is formed on the left and right vertical walls 74B and 74C respectively.

Moreover, as shown in FIG. 2, the push button switch S constituted as described above is set to the clamp 74 by securing the securing protrusion 1*a* of the case 1 to the securing hole 80 of the clamp 74. Furthermore, the push button switch S is set to a panel U by inserting the key top 64 to the opening 81 of the panel U along the back side of the panel U while protruding the key top 64 outward, bringing the clamp 74 into contact with the outer face (back) 1A-2 side of the push button switch S, bringing the clamp 74 into contact with the back of the panel U, and setting the clamp 74 to the panel U by a screw member (not illustrated) at setting portions 74B and 74C of the clamp 74.

Figure 28:
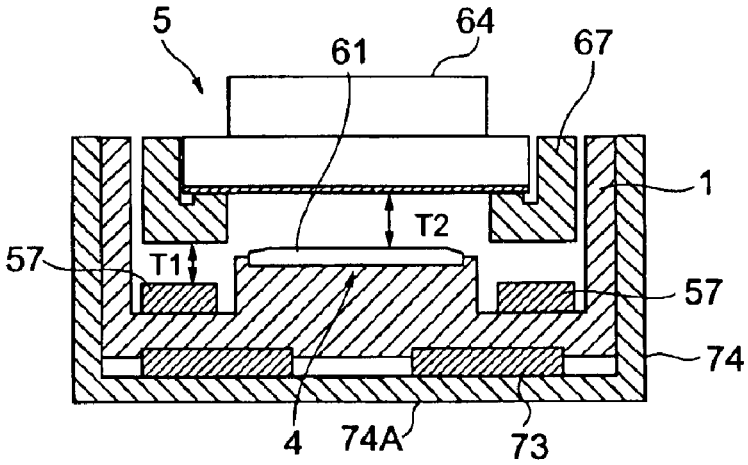
FIG. 28 is an illustration showing a state in which a push button portion separates from a stopper member before the push button portion is pushed.

In this case, as shown in FIG. 28, the shock absorbing member 73 contacts with the face 74A of the clamp 74, the push button portion 5 is raised by the resilience of the movable electrode, and the lower end of the operating shaft 67 has a gap T1 between the lower end and the stopper member 57 set to the case 1 and moreover, a gap T2 is present between the push button portion 5 and the light guiding plate 61 of the illuminating portion 4. Moreover, the gap T1 is set to a dimension smaller than the gap T2.

Then, operations of the push button switch S constituted as described above are described below.

By connecting a connector 82 connected to the printed circuit board 55 through a lead wire 82*a* to a power source, power is supplied to the built-in switch 2 connected to the printed circuit board 55.

Figure 27:
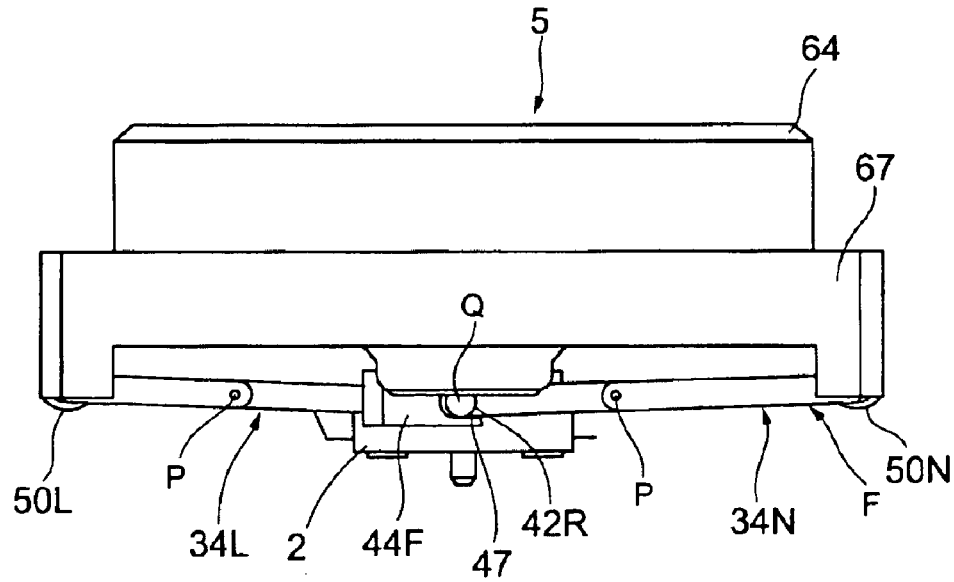
FIG. 27 is an illustration for explaining the behavior of a lever member after a push button portion is pushed.

When the operating shaft 67 is pushed in by pushing in the key top 64 of the push button portion 5 by a finger, the lever contact portion 69 formed on the operating shaft 67 pushes in the connecting shaft 35 of the left and right lever members 34L and 34N. Thereby, the left lever member 34L rotates counterclockwise about the rocking fulcrum P of the member 34L as shown in FIG. 26, the right lever member 34N rotates clockwise about the rocking fulcrum of the member 34N as shown in FIG. 26, and the lever folding point Q for the left and right lever members 34L and 34N is raised as shown in FIG. 27. Therefore, the push button portion 5 moves in parallel.

Thus, because the lever folding point Q for the left and right lever members 34L and 34N is raised, the switch operating member 48 moves in the pushed direction of the push button portion 5 to push in the push button 30 of the built-in switch 2 through the muffling member 51. Therefore, the movable electrode is pushed in and inverted and the movable contact point of the movable electrode contacts with the fixed contact point to turn on the switch.

In this case, a noise of "click" generated when the movable electrode of the built-in switch 2 is pushed in and inverted and the movable point of the movable electrode contacts with the fixed contact point is eliminated by the muffling member 51.

That is, when the muffling member 51 is absent and the switch operating member 48 is set so as to directly contact with the push button 30 of the built-in switch 2, the switch operating member 48 directly pushes in the push button 30 of the built-in switch 2 and thereby, a force for the switch operating member 48 to push the push button 30 is added to the pushing force of the push button 30, the collision speed of the movable contact point of the movable electrode of the built-in switch 2 against the fixed contact point is increased, and the collision load between the contact points is increased to generate noises.

However, because the muffling member 51 is present between the switch operating member 48 and the push button 30 of the built-in switch 2, the switch operating member 48 pushes in the push button 30 of the built-in switch 2 through the muffling member 51 and thereby, the spring force of the muffling member 51 acts in the direction opposite to the pushed direction of the push button 30, that is, the switch operating member 48 acts so as to cancel the pressure for the switch operating member 48 to push the bush button 30, the collision speed of the movable contact point of the movable electrode of the built-in switch 2 against the fixed contact point decreases, the collision load between the contact points decreases, and noises are eliminated.

Moreover, the LED 62B of the LED module 62 emits light, the light is diffused by the light guiding plate 61, spreads in all directions, and is reflected from the reflection case 60 to illuminate diffusion plate 66 from its back. Therefore, characters on the character plate 65 are viewed from the outer side of the key top 64 serving as the front of the push button portion 5 by the light passing through the diffusion plate 66.

Furthermore, by canceling the pressure of the key top 64 of the push button portion 5, the resilience of the movable electrode formed by the spring material of the built-in switch 2 pushes up the bush button 30 of the built-in switch 2 and the movable contact point of the movable electrode separates from the fixed contact point to turn off the switch. In this case, the muffling member 51 and switch operating member 48 along the push button 30 are pushed up and moreover, the key top 64 and operating shaft 67 are pushed up.

Therefore, the left lever member 34L rotates clockwise about its rocking fulcrum P as shown in FIG. 27, the right lever member 34N rotates counterclockwise abut its rocking fulcrum as shown in FIG. 27, and the lever folding point Q of the left and right lever members 34L and 34N lowers to become the state shown in FIG. 26.

Figure 29:
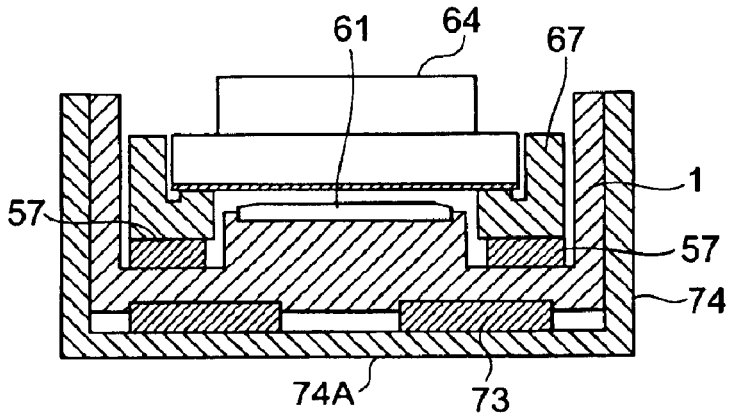
FIG. 29 is an illustration showing a state in which a push button portion contacts a stopper member in the normal state.
Figure 30:
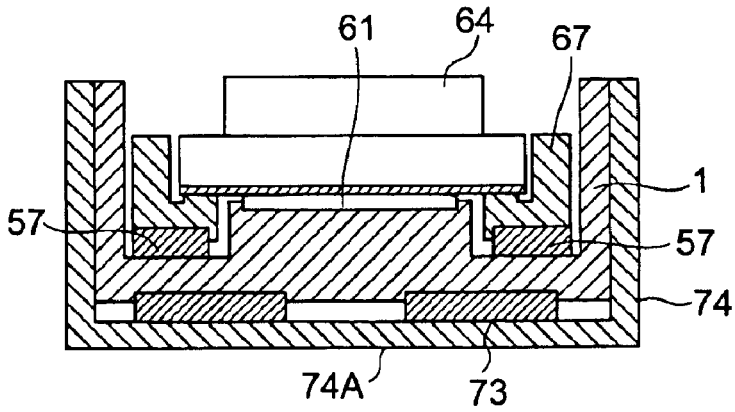
FIG. 30 is an illustration showing a state in which a push button portion contacts a stopper member in an emergency.

When normally pushing the key top 64 of the push button portion 5, the lower end of the operating shaft 67 contacts the elastic stopper member 57 as shown in FIG. 29 to correspond to the pressure of the member 57. However, when pushing the key top 64 of the push button portion 5 at an excessive pressure, the lower end of the operating shaft 67 collides with the stopper member 57 as shown in FIG. 30, the stopper member 57 deflects, collides with the light guiding plate 61 at the case 1 side and is supported by the case 1, and the case 1 is supported by the shock absorbing member 73. Therefore, the push button switch S is prevented from being broken due to the pressure.

According to the above embodiment, a contact gap necessary to open or close the contact point of the built-in switch 2, that is, the opening distance between contact points for the built-in switch 2 to be safely turned off is different from the movement stroke of the push button portion 5. A movement stroke equal to or more than the opening distance between contact points for a contact point portion to be safely turned off has been necessary for a push button portion (key top) so far. However, because it is possible to adjust the difference between a predetermined stroke of the push button portion 5 and a stroke (contact point gap) necessary to open or close the contact point of the built-in switch 2 by selecting a lever ratio between the lever members 34L and 34N, it is possible to securely operate the built-in switch 2 by the predetermined movement stroke of the push button portion 5.

For example, when making the movement stroke of the push button portion 5 smaller than the stroke (contact point gap) necessary to open or close the contact point of the built-in switch 2 so as to securely operate the built-in switch 2, it is only necessary to use the lever members 34L and 34N having lever ratios different each other obtained by changing the distance L1 between a pushing-force acting point "a" located on the connecting shaft 35 and the rocking fulcrum P and the distance L2 between the rocking fulcrum P and the lever folding point Q as shown in FIG. 12.

Thus, because the built-in switch 2 can be securely operated by making the movement stroke of the push button portion 5 smaller than the stroke (contact point gap) necessary to open or close the contact point of the built-in switch, it is possible to decrease the thickness of the push button switch S.

Moreover, because the push button portion 5 is moved in its pushing direction in parallel by the lever link mechanism F, it is possible to operate the lever members 34L and 34N and securely operate the built-in switch 2 through the switch operating member 31 even if pushing the push button portion 5 in accordance with a deviated pushing way.

Particularly, because the lever link mechanism F has a pair of left and right lever members 34L and 34N which rock about the rocking fulcrum P and the both lever members 34L and 34N are connected each other so that they can be bent by the joint members 44F and 44R at the facing end at which the members 34L and 34N are faced each other, it is unnecessary to use an elevating link constituted by connecting two links having been generally used each other at their intermediate portions and therefore, it is possible to decrease the thickness of the push button switch S.

Moreover, according to this embodiment described above, the both lever members 43L and 43N are constituted by bending one wire and have the connecting shaft 35 and arms 38F and 38R formed at the both ends of the connecting shaft 35, fronts of the arms 38F and 38R are formed into faced ends, the joint member 44F is set to the left (one) lever member 34L by inserting the pin portion 42F of the arm 38F into the pin inserting hole 45 of the joint member 44F and the connecting portion 41F into the pin inserting groove 46, the joint member 44R is set to the right (the other) lever member 34N by inserting the pin portion 42F of the arm 38F of the member 34N into the pin inserting hole 45 of the joint member 44R and connecting portion 41F into the pin inserting groove 46, the pin portion 42R of the left lever member 34L is inserted into the slide groove 47 of the joint member 44F, and the pin portion 42R of the right lever member 34N is inserted into the slide groove 47 of the joint member 44R so as to form the lever folding point Q for joint-moving the left and right lever members 34L and 34N on a line "c" connecting the pins 42R serving as lever-side sliding portions of the left and right lever members 34L and 34N each other. Therefore, by pushing the push button portion 5, it is possible to move the push button portion 5 in its bushing direction in parallel by the lever link mechanism F, joint-move the left and right lever members 34L and 34N constituting the lever link mechanism F at the lever folding point Q by rocking the members 34L and 34N about their rocking fulcrums P when the lever link mechanism F is operated by pushing in the push button portion 5, and easily exhibit the parallel movement function of the lever link mechanism F.

Furthermore, it is possible to form the lever link mechanism F into a simple and low structure and contribute to decrease of the push button switch S in thickness.

Furthermore, according to the above-described embodiment, because a pair of lever members 34L and 34N is constituted by a metallic wire, they become tough. Therefore, though a lever member made of a synthetic resin is weak in shock and may be broken, a lever member of this embodiment is strong in shock and it is not broken and thereby, it withstands long-term use of the push button switch S. Moreover, a lever member of this embodiment can be inexpensively fabricated.

Furthermore, according to the above embodiment, the switch operating member 48 has the switch operating portion 49 at its intermediate portion and the lever-member hanging portions 50L and 50N at its both ends, in which the left lever-member hanging portion 50L is rotatably set to the connecting shaft 35 of the left lever member 34L, the right lever-member hanging portion 50N is rotatably set to the connecting shaft 35 of the right lever member 34N, and the switch operating portion 49 is faced with the push button 30 of the built-in switch 2. Therefore, the lever link mechanism F is able to hold the switch operating member 48 and by operating the level link mechanism F, the switch operating member 48 can securely operate the built-in switch 2.

Furthermore, according to this embodiment, the push button portion 5 contacts the connecting shaft 35 of the left and right lever members 34L and 34N, the switch operating member 48 receives an upheaval force for return in the direction opposite to the pushed direction of the push button portion 5 to join-move the left and right lever members 34L and 34N so that they become convex at the lever folding point Q. Moreover, because the switch operating member 48 pushes up the push button portion 5, by pushing the push button portion 5, the member 48 moves the push button portion 5 in its pushed direction by the lever link mechanism F, rocks the left and right lever members 34L and 34N constituting the lever link mechanism F about the rocking fulcrum P, joint-moves the left and right lever members 34L and 34N so that they become convex in the direction opposite to the pushed direction at the lever holding point Q and works so as to push down the switch operating member 48. Thereby, it is possible to securely operate the built-in switch 2 and particularly, form the lever link mechanism F into a low structure and contribute to decrease of the push button switch S in thickness.

Furthermore, according to this embodiment, because the muffling member 51 is present between the switch operating member 48 and the push button 30 of the built-in switch 2, when the switch operating member 48 pushes in the push button 30 of the built-in switch 2 through the muffling member 51, a pressure for the switch operating member 48 to push the push button 30 is added to the pushing force by the member 48. However, because the spring force of the muffling member 51 works in the direction opposite to the pushed direction of the push button 30, that is, the spring force of the muffling member 51 acts so as to cancel the pressure, the collision speed of the movable contact point of the built-in switch 2 against the fixed contact point decreases, the collision load between the contact points decreases, and it is possible to eliminate a noise of "click" generated when the movable contact point contacts the fixed point.

Furthermore, according to this embodiment, by setting the illuminating portion 4 for illuminating the front of the push button portion 5 to the case 1 so as to cover the switch operating member 48, it is possible to realize a low structure and contribute to decrease of a push button switch in thickness.

Furthermore, according to this embodiment, when pushing the key top 64 at an excessive pressure, an end of the operating shaft 67 collides with the stopper member 57, the stopper member 57 deflects and collides with the illuminating portion 4 present at the case 1 side and supported by the case 1, and moreover the case 1 is supported by the shock absorbing member 73. Therefore, it is possible to prevent the push button switch S from being broken due to a pressure.

Figure 31:
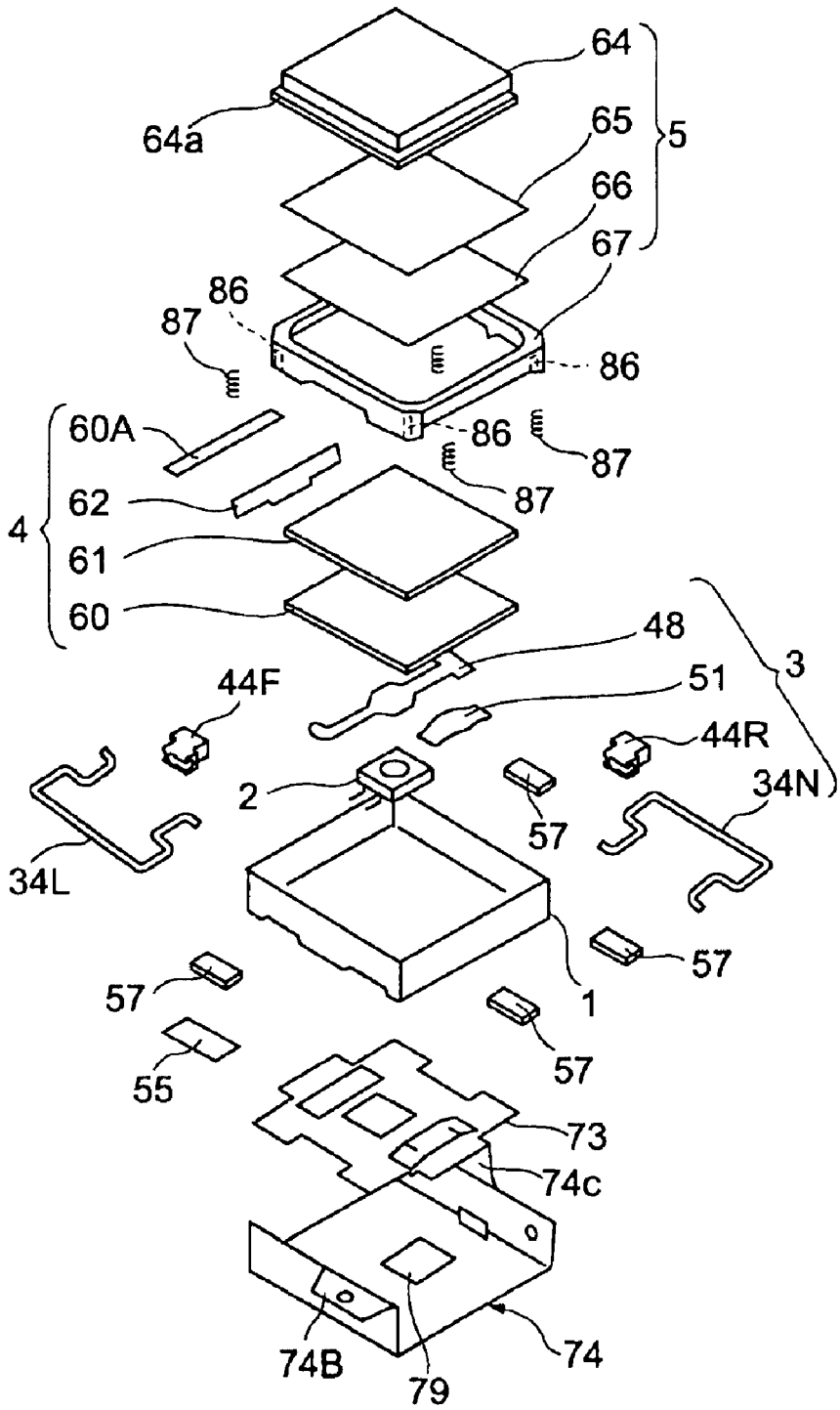
FIG. 31 is a schematic perspective view of a push button switch having a return coil spring while the switch is disassembled.
Figure 32:
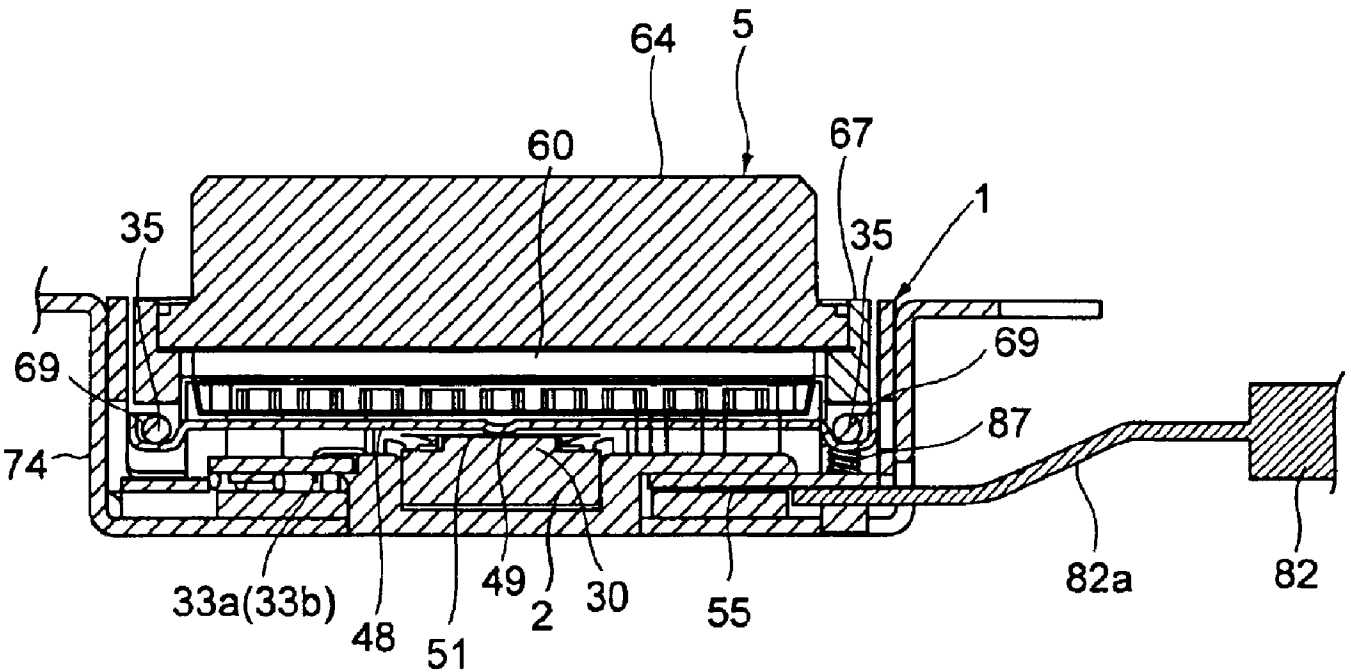
FIG. 32 is a sectional view of the push button switch in FIG. 31 while the push button switch is set to a clamp.
Figure 33:
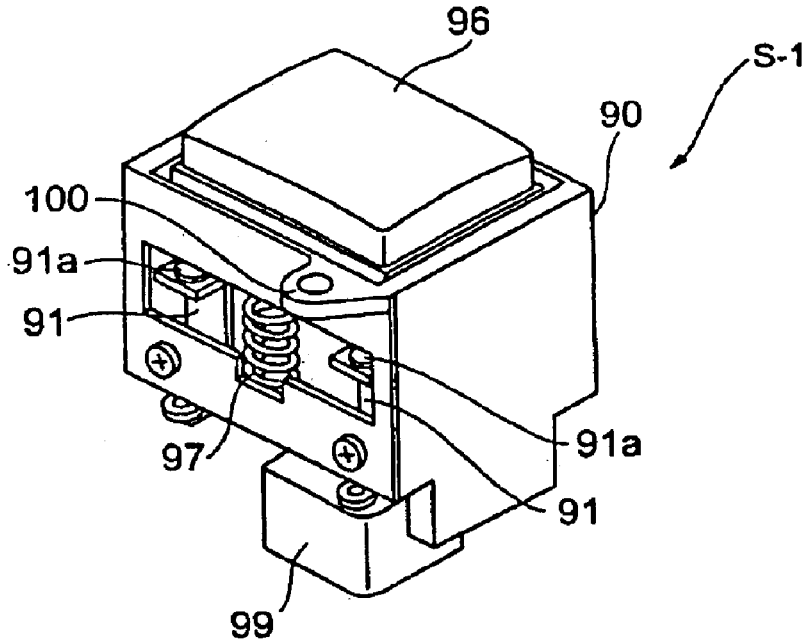
Fig. 33 PRIOR ART
FIG. 33 is a perspective view of a conventional push button switch.
Figure 34:
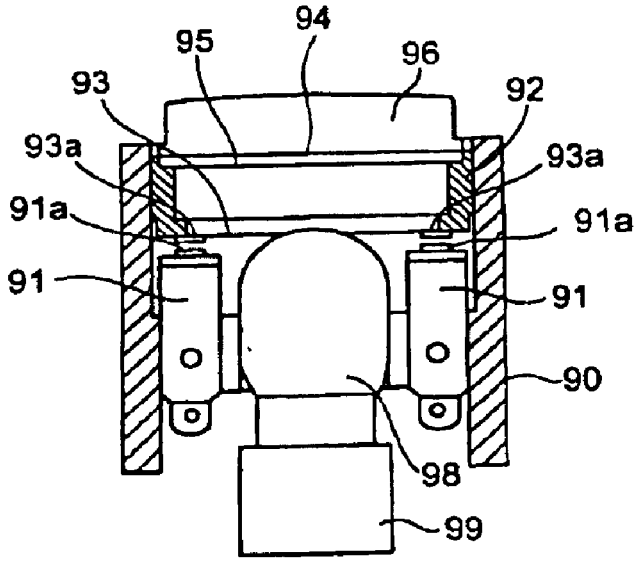
Fig. 34 PRIOR ART
FIG. 34 is a sectional view of a conventional push button switch.

Furthermore, as shown in FIGS. 31 and 32, it is also allowed to form a spring setting hole 86 at lower ends of four corners of the operating shaft 67, set a return coil spring 87 to these spring setting holes 86, and use spring forces of these return coil springs 87 to return the push button portion 5.

As described above, according to a push button switch of the present invention, by pushing a push button portion, it is possible to move the push button portion in parallel in its pushed direction by a lever link mechanism, rock a lever member constituting the lever link mechanism about a rocking fulcrum when the lever link mechanism operates by pushing in the push button portion, and operate a switch portion by a switch operating member.

A contact gap necessary to open or close the contact point of a switch portion, that is, the opening distance between contact points for the switch portion to be safely turned off is different from the movement stroke of a push button portion. Though a movement stroke equal to or more than the opening distance between contact points for a contact point potion to be safely turned off has been necessary so far for a push button portion (key top), it is possible to securely operate the switch portion by a small movement stroke of the push button portion because the difference between a predetermined movement stroke of the push button portion and a stroke (contact point gap) necessary to open or close the switch portion can be adjusted by selecting a lever ratio of a lever member.

That is, to securely operate a switch portion by making the movement stroke of a push button portion smaller than the stroke (contact point gap) necessary to open or close the contact point of the switch portion, it is only necessary to use lever members having lever ratio different each other.

Thus, because a switch portion can be securely operated by making the movement stroke of the push button portion smaller than the stroke (contact point gap) necessary to open or close the contact point of the switch portion, it is possible to decrease the thickness of a push button switch.

Particularly, because a lever link mechanism has a pair of lever members which rock about a rocking fulcrum and the both lever members are constituted by overlapping each other so that they can be folded and slid at their ends faced each other, it is unnecessary to use an elevating link constituted by slidably connecting two links having been generally used at their intermediate portions and it is possible to decrease the thickness of a push button switch.

What is claimed is:

1. A push button switch in which a push button portion and a switch portion are housed in a case so as to open or close the switch portion by pushing in the push button portion, comprising:

a lever-link mechanism having a pair of lever members which rock about a rocking fulcrum by interlocking with the push button portion when the push button portion is pushed in and are arranged so as to face each other, in which the both lever members are arranged relative to each other so that they can be folded and slid at their facing ends to face each other; and a switch operating member for opening or closing the switch portion when the lever link mechanism is rocked because the push button portion is pushed in, and wherein one of the lever members is fixed to one joint member at the facing end of one arm and the facing end of the other arm is slidably connected to the other joint, the other lever member is fixed to the other joint member at the facing end of the one arm and the facing end of the other arm is slidably connected to the one joint, and a lever folding point is formed on a straight line connecting the facing end of the other arm of the one lever member with the facing end of the other arm of the other lever member.

2. The push button switch according to claim 1, wherein the lever members are respectively constituted by a wire.

3. The push button switch according to claim 1, wherein a muffling member for generating a spring force in the direction opposite to the pushed direction of the push button portion when the push button portion is pushed in is set between the switch operating member and the switch portion.

4. The push button switch according to claim 1, wherein an illuminating portion for illuminating the front of the push button portion is set to the case so as to cover the switch operating member.

5. The push button switch according to claim 1, wherein an elastic stopper member with which the push button portion contacts when the push button portion is pushed in is set to the case.

6. The push button switch according to claim 1, wherein a shock absorbing member is set between the case and a clamp of the case.

* * * * *